US012553429B2

(12) United States Patent
Urata et al.

(10) Patent No.: US 12,553,429 B2
(45) Date of Patent: Feb. 17, 2026

(54) BELLOWS PUMP DEVICE

(71) Applicant: Nippon Pillar Packing Co., Ltd., Osaka (JP)

(72) Inventors: Daisuke Urata, Osaka (JP); Kazukiyo Teshima, Osaka (JP); Atsufumi Kinoshita, Osaka (JP)

(73) Assignee: Nippon Pillar Packing Co., Ltd., Osaka (JP)

( * ) Notice: Subject to any disclaimer, the term of this patent is extended or adjusted under 35 U.S.C. 154(b) by 269 days.

(21) Appl. No.: 18/266,922

(22) PCT Filed: Sep. 22, 2021

(86) PCT No.: PCT/JP2021/034699

§ 371 (c)(1),
(2) Date: Jun. 13, 2023

(87) PCT Pub. No.: WO2022/130722

PCT Pub. Date: Jun. 23, 2022

(65) Prior Publication Data

US 2024/0044325 A1 Feb. 8, 2024

(30) Foreign Application Priority Data

Dec. 16, 2020 (JP) ..... 2020-208526

(51) Int. Cl.
*F04B 45/02* (2006.01)
*F04B 43/08* (2006.01)
(Continued)

(52) U.S. Cl.
CPC ..... *F04B 45/022* (2013.01); *F04B 43/084* (2013.01); *F04B 43/10* (2013.01); *F04B 45/033* (2013.01); *F04B 49/08* (2013.01)

(58) Field of Classification Search
CPC ..... F04B 43/084–086; F04B 43/10; F04B 43/1136; F04B 45/022; F04B 45/033; F04B 49/08
See application file for complete search history.

(56) References Cited

U.S. PATENT DOCUMENTS 6,322,338 B1 * 11/2001 Nishio ..... F04B 11/0016 138/30
9,239,047 B2 * 1/2016 Iwabuchi ..... F04B 43/0009
(Continued)

FOREIGN PATENT DOCUMENTS

CN 102057160 A * 5/2011 ..... F04B 53/10
CN 103388577 A * 11/2013
(Continued)

OTHER PUBLICATIONS

International Search Report PCT/JP2021/034699 dated Nov. 16, 2021 (pp. 1-2).

*Primary Examiner* — Alexander B Comley
(74) *Attorney, Agent, or Firm* — Christopher B. Kilner; MILLEN, WHITE, ZELANO & BRANIGAN, P.C.

(57) ABSTRACT

A control unit 6 of a bellows pump device 1 determines whether or not a second bellows 14 (first bellows 13) is in a predetermined expanded state when the first bellows 13 (second bellows 14) contracts to a mid-contraction state, on the basis of respective detection signals of a first detection unit 29 and a second detection unit 31, and when a determination result of the determination is negative, the control unit 6 performs next pressure increase control of controlling a second electropneumatic regulator 52 (first electropneumatic regulator 51) such that an air pressure of a pressurized air to be supplied to a second suction-side air chamber 26B (first suction-side air chamber 26A) of a second driving unit
(Continued)

28 (first driving unit 27) at next expansion of the second bellows 14 (first bellows 13) is increased.

4 Claims, 9 Drawing Sheets

(51) Int. Cl.
*F04B 43/10* (2006.01)
*F04B 45/033* (2006.01)
*F04B 49/08* (2006.01)

(56) References Cited

U.S. PATENT DOCUMENTS 10,309,391 B2 * 6/2019 Matsuda ..... F04B 43/08
10,718,324 B2 * 7/2020 Nakano ..... F04B 45/022
2006/0165541 A1 * 7/2006 Teshima ..... F04B 43/10
417/472
2010/0119392 A1 * 5/2010 Masuda ..... F04B 43/084
417/472
2011/0318207 A1 * 12/2011 Katsura ..... F04B 43/086
417/472
2014/0072465 A1 * 3/2014 Adachi ..... F04B 45/022
417/472
2016/0377071 A1 * 12/2016 Fujii ..... F04B 43/0072
417/472
2017/0191476 A1 * 7/2017 Matsuda ..... F04B 53/10
2017/0218946 A1 * 8/2017 Yamada ..... F04B 49/06
2017/0350382 A1 * 12/2017 Nakano ..... F04B 43/10
2020/0182234 A1 * 6/2020 Nakano ..... F04B 49/08

FOREIGN PATENT DOCUMENTS

JP H0814163 A * 1/1996
JP 3519364 B2 * 4/2004
JP 2004293502 A * 10/2004
JP 5315550 B2 * 10/2013 ..... F04B 43/113
JP 5559020 B2 * 7/2014
JP 5720888 B2 * 5/2015 ..... F04B 45/022
JP 2016037912 A * 3/2016
JP 2016109022 A * 6/2016
JP 2018025143 A * 2/2018
JP 2021042685 A * 3/2021 ..... F04B 49/22

* cited by examiner

BELLOWS PUMP DEVICE

TECHNICAL FIELD

The present invention relates to a bellows pump device.

BACKGROUND ART

As a bellows pump used for feeding a transport fluid such as a chemical solution or a solvent in semiconductor production, chemical industries, or the like, a bellows pump which includes: a pair of bellows configured to suck a transport fluid thereinto and discharge the transport fluid therefrom by expanding/contracting independently of each other; and a pair of air cylinders configured to cause the respective bellows to expand/contract, by supplying/discharging pressurized air, is known (see, for example, PATENT LITERATURE 1). The bellows pump described in PATENT LITERATURE 1 controls drive of each air cylinder such that, before one bellows contracts most (ends the discharge), the other bellows is caused to contract from a most expanded state to discharge the transport fluid.

By controlling drive of each air cylinder as described above, at a time of switching from contraction of one bellows to expansion thereof (from discharge of the transport fluid to suction thereof), the other bellows has already contracted to discharge the transport fluid. Accordingly, great fall of the discharge pressure of the transport fluid at the above time can be reduced, so that pulsation at the discharge side of the bellows pump can be reduced.

CITATION LIST

Patent Literature

PATENT LITERATURE 1: Japanese Laid-Open Patent Publication No. 2004-293502

SUMMARY OF THE INVENTION

Technical Problem

In the above bellows pump, before one bellows contracts most (ends the discharge), it is necessary to cause the other bellows to expand most (end the suction). However, when the atmospheric temperature, the flow rate of the transport fluid, or the like changes, the hardness of each bellows changes due to the influence thereof. When the hardness of each bellows changes, the expansion time (suction time) of the bellows changes, causing various problems.

For example, if the other bellows becomes harder, it becomes more difficult for the other bellows to expand, so that the expansion time thereof becomes longer. In such a case, it is not possible to cause the other bellows to expand most before the one bellows contracts most, so that pulsation at the discharge side of the bellows pump is deteriorated.

In addition, if the other bellows becomes softer, it becomes easier for the other bellows to expand, so that the expansion time thereof becomes shorter. In such a case, the expansion speed of the other bellows becomes higher, so that a negative pressure is generated inside the other bellows. When such a negative pressure is generated, an impact pressure called "water hammer" may be generated, or cavitation may occur, in a suction pipe through which the transport fluid is sucked into the other bellows, which may adversely affect a semiconductor manufacturing process or the like.

To prevent the above problems from occurring, the air pressure of the pressurized air to be supplied to an air chamber of the corresponding air cylinder needs to be reset to an appropriate value such that the expansion time of the bellows becomes an appropriate time. However, in the conventional bellows pump, it is necessary to manually reset the above air pressure each time the expansion time of the bellows changes.

The present invention has been made in view of such circumstances, and an object of the present invention is to provide a bellows pump device that can automatically reset a fluid pressure of a pressurized fluid for causing a bellows to expand, when an expansion time of the bellows changes.

Solution to Problem (1) The present invention is directed to a bellows pump device including: a pair of bellows expandable/contractible independently of each other and configured to suck a transport fluid thereinto by expansion thereof and to discharge the transport fluid therefrom by contraction thereof; a pair of driving units each having a suction-side fluid chamber and a discharge-side fluid chamber and configured to cause the respective bellows to expand to a predetermined expanded state by supplying a pressurized fluid to the suction-side fluid chambers and to cause the respective bellows to contract to a predetermined contracted state by supplying the pressurized fluid to the discharge-side fluid chambers; a control unit configured to perform drive control of the pair of driving units such that, before one bellows out of the pair of bellows comes into the contracted state, the other bellows is caused to contract from the expanded state; a pair of detection units configured to detect expanded/contracted states of the respective bellows; and a pair of fluid pressure adjustment units configured to adjust fluid pressures of the pressurized fluid to be supplied to the suction-side fluid chambers of the respective driving units, wherein the control unit determines whether or not the other bellows is in the expanded state when the one bellows contracts to a mid-contraction state before the contracted state, on the basis of respective detection signals of the pair of detection units, and when a determination result of the determination is negative, the control unit performs next pressure increase control of controlling the fluid pressure adjustment unit corresponding to the driving unit for causing the other bellows to expand, such that the fluid pressure at next expansion of the other bellows is increased.

In the bellows pump device of the present invention, when the one bellows contracts to the mid-contraction state, the other bellows has not expanded to the predetermined expanded state in some cases. This is because the expansion time of the other bellows becomes longer due to the other bellows becoming harder. In such a case, the control unit performs next pressure increase control of increasing the fluid pressure of the pressurized fluid to be supplied to the suction-side fluid chamber of the corresponding driving unit at the next expansion of the other bellows. Accordingly, when the expansion time of the other bellows becomes longer, the fluid pressure of the pressurized fluid for causing the other bellows to expand can be automatically reset to a higher value. As a result, the next expansion time of the other bellows becomes shorter, so that deterioration of pulsation at the discharge side of the bellows pump device due to the expansion time becoming longer can be suppressed.

(2) According to another aspect, the present invention is directed to a bellows pump device including: a pair of bellows expandable/contractible independently of each other and configured to suck a transport fluid thereinto by expansion thereof and discharge the transport fluid therefrom by contraction thereof; a pair of driving units each having a suction-side fluid chamber and a discharge-side fluid chamber and configured to cause the respective bellows to expand to a predetermined expanded state by supplying a pressurized fluid to the suction-side fluid chambers and to cause the respective bellows to contract to a predetermined contracted state by supplying the pressurized fluid to the discharge-side fluid chambers; a control unit configured to perform drive control of the pair of driving units such that, before one bellows out of the pair of bellows comes into the contracted state, the other bellows is caused to contract from the expanded state; a pair of detection units configured to detect expanded/contracted states of the respective bellows; and a pair of fluid pressure adjustment units configured to adjust fluid pressures of the pressurized fluid to be supplied to the suction-side fluid chambers of the respective driving units, wherein the control unit determines whether or not the other bellows is in the expanded state when the one bellows contracts to a mid-contraction state before the contracted state or when the one bellows contracts to the contracted state, on the basis of respective detection signals of the pair of detection units, and when a determination result of the determination is negative, the control unit performs current-time pressure increase control of controlling the fluid pressure adjustment unit corresponding to the driving unit for causing the other bellows to expand, such that the fluid pressure for the other bellows which is expanding at a current time is gradually increased.

In the bellows pump device of the present invention, when the one bellows contracts to the mid-contraction state or when the one bellows contracts to the contracted state, the other bellows has not expanded to the predetermined expanded state in some cases. This is because the expansion time of the other bellows becomes longer due to the other bellows becoming harder. In such a case, for the other bellows which is expanding at the current time, the control unit performs current-time pressure increase control of gradually increasing the fluid pressure of the pressurized fluid currently supplied to the suction-side fluid chamber of the corresponding driving unit. Accordingly, when the expansion time of the other bellows becomes longer, the fluid pressure of the pressurized fluid for causing the other bellows to expand can be automatically reset such that the fluid pressure gradually becomes higher values. As a result, the expansion time of the other bellows at the current time becomes shorter, so that deterioration of pulsation at the discharge side of the bellows pump device due to the expansion time becoming longer can be suppressed.

(3) According to still another aspect, the present invention is directed to a bellows pump device including: a pair of bellows expandable/contractible independently of each other and configured to suck a transport fluid thereinto by expansion thereof and discharge the transport fluid therefrom by contraction thereof; a pair of driving units each having a suction-side fluid chamber and a discharge-side fluid chamber and configured to cause the respective bellows to expand to a predetermined expanded state by supplying a pressurized fluid to the suction-side fluid chambers and to cause the respective bellows to contract to a predetermined contracted state by supplying the pressurized fluid to the discharge-side fluid chambers; a control unit configured to perform drive control of the pair of driving units such that, before one bellows out of the pair of bellows comes into the contracted state, the other bellows is caused to contract from the expanded state; a pair of detection units configured to detect expanded/contracted states of the respective bellows; and a pair of fluid pressure adjustment units configured to adjust fluid pressures of the pressurized fluid to be supplied to the suction-side fluid chambers of the respective driving units, wherein the control unit determines whether or not the other bellows has continued to be in the expanded state for a predetermined time or longer when the one bellows contracts to a mid-contraction state before the contracted state, on the basis of respective detection signals of the pair of detection units, and when a determination result of the determination is positive, the control unit performs pressure decrease control of controlling the fluid pressure adjustment unit corresponding to the driving unit for causing the other bellows to expand, such that the fluid pressure at next expansion of the other bellows is decreased.

In the bellows pump device of the present invention, when the one bellows contracts to the mid-contraction state, the other bellows has continued to be in the predetermined expanded state for the predetermined time or longer in some cases. This is because the expansion time of the other bellows becomes shorter than necessary due to the other bellows becoming softer. In such a case, the control unit performs pressure decrease control of decreasing the fluid pressure of the pressurized fluid to be supplied to the suction-side fluid chamber of the corresponding driving unit at the next expansion of the other bellows. Accordingly, when the expansion time of the other bellows becomes shorter than necessary, the fluid pressure of the pressurized fluid for causing the other bellows to expand can be automatically reset to a lower value. As a result, the next expansion time of the other bellows becomes longer, and the expansion speed thereof decreases, so that generation of an impact pressure or occurrence of cavitation can be suppressed.

(4) Preferably, the control unit in the above (1) determines whether or not the other bellows has continued to be in the expanded state for a predetermined time or longer when the one bellows contracts to the mid-contraction state, on the basis of the respective detection signals of the pair of detection units, and when a determination result of the determination is positive, the control unit performs pressure decrease control of controlling the fluid pressure adjustment unit corresponding to the driving unit for causing the other bellows to expand, such that the fluid pressure at the next expansion of the other bellows is decreased.

In this case, both the next pressure increase control and the pressure decrease control are performed. Accordingly, when the expansion time of the other bellows becomes longer, the fluid pressure of the pressurized fluid for causing the other bellows to expand can be automatically reset to a higher value, and when the expansion time of the other bellows becomes shorter than necessary, the fluid pressure of the pressurized fluid for causing the other bellows to expand can be automatically reset to a lower value.

(5) Preferably, the control unit determines whether or not the other bellows is in the expanded state when the one bellows contracts to the contracted state, on the basis of the respective detection signals of the pair of detection units, and when a determination result of the determination is negative, the control unit sets a lower limit of a range of adjustment of the fluid pressure by the fluid pressure adjustment unit at the next expansion of the other bellows such that the lower limit is higher than the fluid pressure at last expansion of the other bellows.

In the case where the control unit performs the pressure decrease control, when the one bellows contracts to the predetermined contracted state, the other bellows has not expanded to the predetermined expanded state in some cases. This is because the fluid pressure of the pressurized fluid to be supplied to the suction-side fluid chamber of the corresponding driving unit is decreased more than necessary by the pressure decrease control, so that the expansion time of the other bellows becomes excessively long. In such a case, the control unit sets the lower limit of the range of adjustment of the fluid pressure at the next expansion of the other bellows such that the lower limit is higher than the fluid pressure at the last expansion of the other bellows. Accordingly, the fluid pressure adjusted by the fluid pressure adjustment unit at the next expansion of the other bellows can be prevented from being lower than the lower limit, so that the expansion time of the other bellows can be inhibited from becoming excessively long. As a result, deterioration of pulsation at the discharge side of the bellows pump device due to the expansion time becoming longer can be suppressed.

(6) Preferably, the control unit determines whether or not the other bellows is in the expanded state when the one bellows contracts to the contracted state, on the basis of the respective detection signals of the pair of detection units, and when a determination result of the determination is negative, the control unit sets a lower limit of a range of adjustment of the fluid pressure by the fluid pressure adjustment unit at expansion of the other bellows subsequent to the next expansion thereof such that the lower limit is higher than the fluid pressure at the last expansion of the other bellows.

In the case where the control unit performs the pressure decrease control, when the one bellows contracts to the predetermined contracted state, the other bellows has not expanded to the predetermined expanded state in some cases. This is because the fluid pressure of the pressurized fluid to be supplied to the suction-side fluid chamber of the corresponding driving unit is decreased more than necessary by the pressure decrease control, so that the expansion time of the other bellows becomes excessively long. In such a case, the control unit may set the lower limit of the range of adjustment of the fluid pressure at the expansion of the other bellows subsequent to the next expansion thereof such that the lower limit is higher than the fluid pressure at the last expansion of the other bellows. Accordingly, the fluid pressure adjusted by the fluid pressure adjustment unit at the expansion of the other bellows subsequent to the next expansion thereof can be prevented from being lower than the lower limit, so that the expansion time of the other bellows can be inhibited from becoming excessively long. As a result, deterioration of pulsation at the discharge side of the bellows pump device due to the expansion time becoming longer can be suppressed.

(7) Preferably, the control unit determines whether or not the other bellows is in the expanded state when the one bellows contracts to the mid-contraction state before the contracted state or when the one bellows contracts to the contracted state, on the basis of the respective detection signals of the pair of detection units, and when a determination result of the determination is negative, the control unit performs current-time pressure increase control of controlling the fluid pressure adjustment unit corresponding to the driving unit for causing the other bellows to expand, such that the fluid pressure for the other bellows which is expanding at a current time is gradually increased.

In the case where the control unit performs the pressure decrease control, when the one bellows contracts to the predetermined contracted state, the other bellows has not expanded to the predetermined expanded state in some cases. This is because the fluid pressure of the pressurized fluid to be supplied to the suction-side fluid chamber of the corresponding driving unit is decreased more than necessary by the pressure decrease control, so that the expansion time of the other bellows becomes excessively long. In such a case, the control unit performs current-time pressure increase control of gradually increasing the fluid pressure for the other bellows which is expanding at the current time. Accordingly, the expansion time of the other bellows at the current time can be shortened. As a result, deterioration of pulsation at the discharge side of the bellows pump device due to the expansion time becoming longer can be suppressed. In addition, insufficient suction of the transport fluid due to expansion of the other bellows can be suppressed, so that stop of the bellows pump device due to the insufficient suction can be suppressed.

(8) Preferably, the control unit performs the drive control on the basis of the respective detection signals of the pair of detection units.

In this case, since the pair of detection units which are used for the drive control of the pair of driving units also serve as a pair of detection units used for the current-time pressure increase control, the next pressure increase control, or the pressure decrease control, the configuration of the bellows pump device can be simplified.

Advantageous Effects of the Invention

In the bellows pump device of the present invention, when the expansion time of the bellows changes, the fluid pressure of the pressurized fluid for causing the bellows to expand can be automatically reset.

DETAILED DESCRIPTION

Next, a preferred embodiment of the present invention will be described with reference to the accompanying drawings.

[Entire Configuration]

Figure 1:
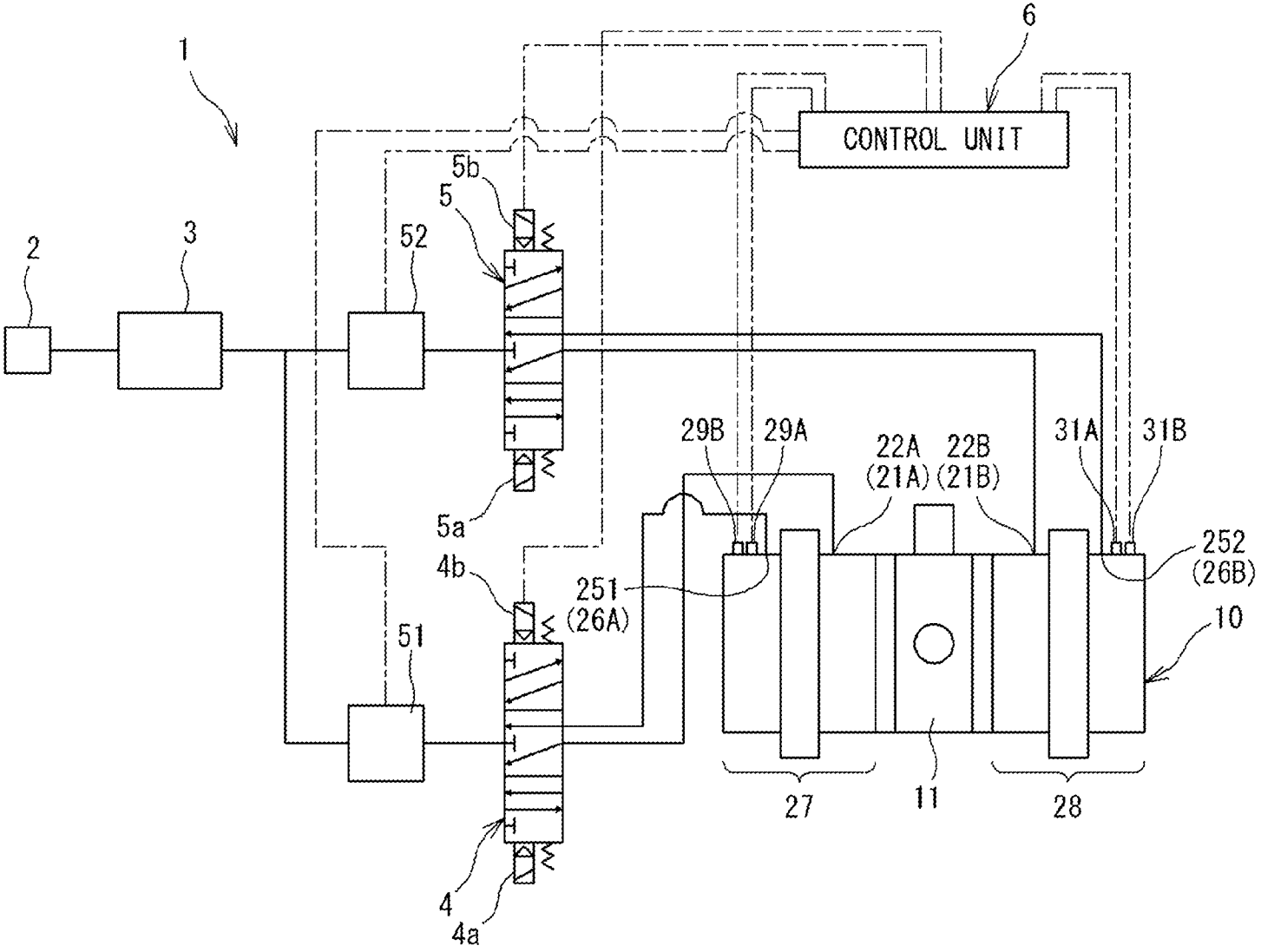
FIG. 1 is a schematic configuration diagram of a bellows pump device according to an embodiment of the present invention.

FIG. 1 is a schematic configuration diagram of a bellows pump device according to an embodiment of the present invention. A bellows pump device 1 of the present embodiment is used, for example, in a semiconductor production apparatus when a transport fluid such as a chemical solution or a solvent is supplied in a certain amount. The bellows pump device 1 includes an air supply device (fluid supply device) 2, a mechanical regulator 3, a first solenoid valve 4, a second solenoid valve 5, a control unit 6, a bellows pump 10, a first electropneumatic regulator (fluid pressure adjustment unit) 51, and a second electropneumatic regulator (fluid pressure adjustment unit) 52.

The air supply device 2 is composed of, for example, an air compressor and generates pressurized air (pressurized fluid) to be supplied to the bellows pump 10. The mechanical regulator 3 adjusts the air pressure (fluid pressure) of the pressurized air generated by the air supply device 2. The first electropneumatic regulator 51 and the second electropneumatic regulator 52 will be described later.

Figure 2:
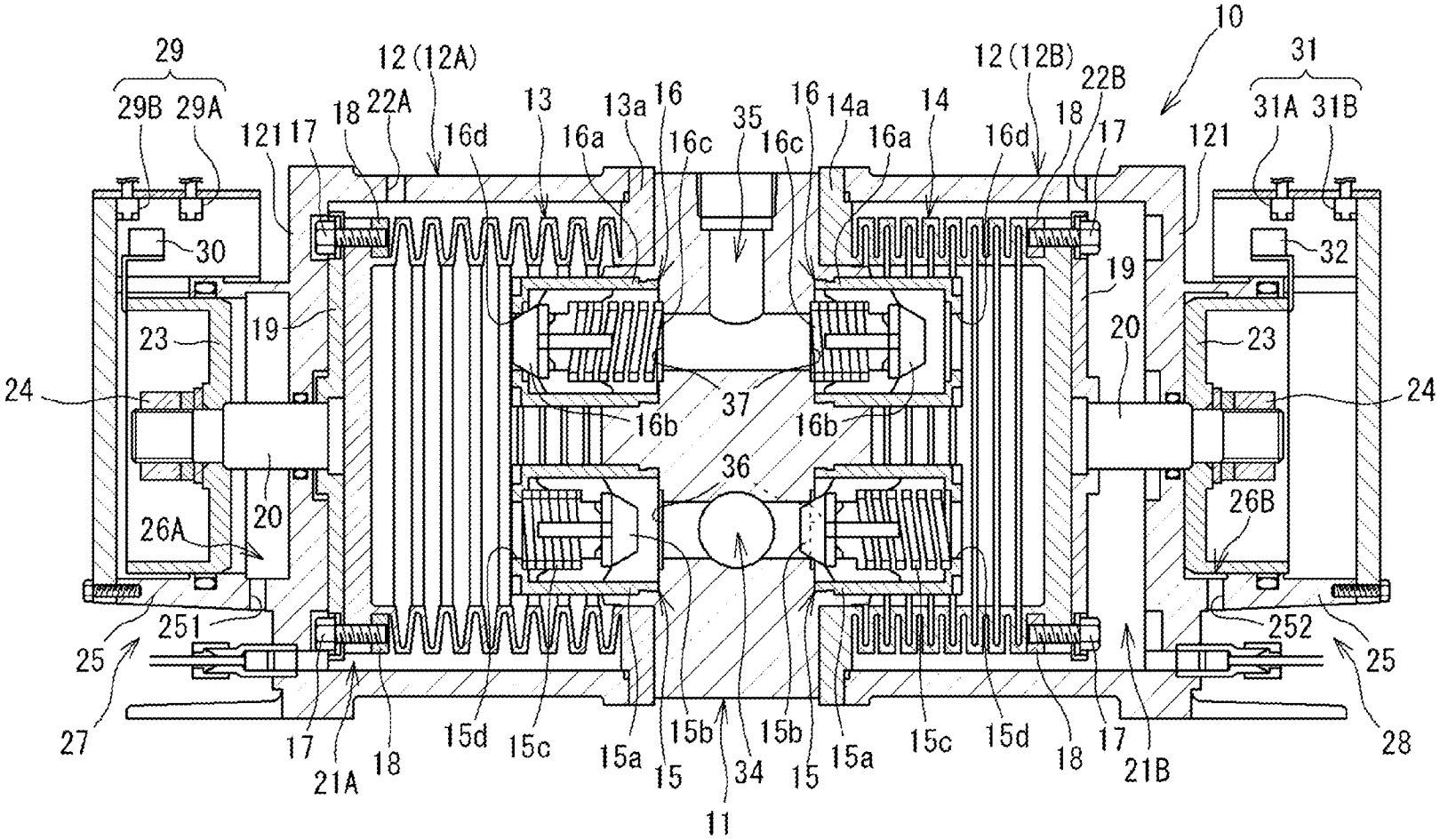
FIG. 2 is a cross-sectional view of a bellows pump.

FIG. 2 is a cross-sectional view of the bellows pump 10 according to the present embodiment. The bellows pump 10 of the present embodiment includes: a pump head 11 which is disposed at a center portion; a pair of pump cases 12 which are mounted at both sides of the pump head 11 in a right-left direction; a first bellows 13 and a second bellows 14 which are a pair of bellows mounted on side surfaces of the pump head 11 in the right-left direction and within the respective pump cases 12; and a total of four check valves 15 and check valves 16 which are mounted on the side surfaces of the pump head 11 in the right-left direction and within the respective first and second bellows 13 and 14.

[Bellows]

The first bellows 13 and the second bellows 14 are each formed in a bottomed cylindrical shape from a fluorine resin such as polytetrafluoroethylene (PTFE) or a tetrafluoroethylene-perfluoro alkyl vinyl ether copolymer (PFA). A flange portion 13*a* and a flange portion 14*a* are integrally formed at open-side end portions of the first and second bellows 13 and 14 and are hermetically pressed and fixed to the side surfaces of the pump head 11. Peripheral walls of the first and second bellows 13 and 14 are each formed in an accordion shape, and are configured to be expandable/contractible independently of each other in the right-left direction.

A working plate 19 is fixed to each of the outer surfaces of closed-side end portions of the first and second bellows 13 and 14 by bolts 17 and nuts 18. Each of the first and second bellows 13 and 14 is expandable/contractible between a most expanded state where the outer surface of the working plate 19 is in contact with the inner surface of a bottom wall portion 121 of the pump case 12 having a bottomed cylindrical shape and a most contracted state where the inner surface of a piston body 23 described later is in contact with the outer surface of the bottom wall portion 121.

[Pump Cases]

An opening peripheral portion of the pump case 12 (hereinafter, also referred to as "first pump case 12A") is hermetically pressed and fixed to the flange portion 13*a* of the first bellows 13. Accordingly, a first discharge-side air chamber (discharge-side fluid chamber) 21A is formed at the outer side of the first bellows 13 within the first pump case 12A such that a hermetic state thereof is maintained.

A first suction/discharge port 22A is provided in the first pump case 12A and connected to the air supply device 2 via the first solenoid valve 4, the first electropneumatic regulator 51, and the mechanical regulator 3 (see FIG. 1). Accordingly, when the pressurized air is supplied from the air supply device 2 to the interior of the first discharge-side air chamber 21A, the first bellows 13 contracts to a predetermined contracted state (hereinafter, simply referred to as "contracted state"). The contracted state of the first bellows 13 may be the most contracted state or may be a state before the most contracted state.

An opening peripheral portion of the pump case 12 (hereinafter, also referred to as "second pump case 12B") is hermetically pressed and fixed to the flange portion 14*a* of the second bellows 14. Accordingly, a second discharge-side air chamber (discharge-side fluid chamber) 21B is formed at the outer side of the second bellows 14 within the second pump case 12B such that a hermetic state thereof is maintained.

A second suction/discharge port 22B is provided in the second pump case 12B and connected to the air supply device 2 via the second solenoid valve 5, the second electropneumatic regulator 52, and the mechanical regulator 3 (see FIG. 1). Accordingly, when the pressurized air is supplied from the air supply device 2 to the interior of the second discharge-side air chamber 21B, the second bellows 14 contracts to a predetermined contracted state (hereinafter, simply referred to as "contracted state"). The contracted state of the second bellows 14 may be the most contracted state or may be a state before the most contracted state.

A rod-shaped connection member 20 penetrates the bottom wall portion 121 of each pump case 12A, 12B and is supported so as to be slidable in the right-left direction relative to the bottom wall portion 121. The piston body 23 is fixed to an outer end portion of the connection member 20 by a nut 24. The piston body 23 is supported so as to be slidable in the right-left direction relative to an inner circumferential surface of a cylindrical cylinder body 25, which is integrally provided at the outer side of the bottom wall portion 121, with a hermetic state maintained.

Accordingly, at the first pump case 12A side, a space surrounded by the bottom wall portion 121, the cylinder body 25, and the piston body 23 is formed as a first suction-side air chamber (suction-side fluid chamber) 26A of which a hermetic state is maintained. In addition, at the second pump case 12B side, a space surrounded by the bottom wall portion 121, the cylinder body 25, and the piston body 23 is formed as a second suction-side air chamber (suction-side fluid chamber) 26B of which a hermetic state is maintained.

In the cylinder body 25 at the first pump case 12A side, a suction/discharge port 251 is formed so as to communicate with the first suction-side air chamber 26A. The suction/discharge port 251 is connected to the air supply device 2 via the first solenoid valve 4, the first electropneumatic regulator 51, and the mechanical regulator 3 (see FIG. 1). Accordingly, when the pressurized air is supplied from the air supply device 2 to the interior of the first suction-side air chamber 26A via the suction/discharge port 251, the first bellows 13 expands to a predetermined expanded state (hereinafter, simply referred to as "expanded state"). The expanded state of the first bellows 13 may be the most expanded state or may be a state before the most expanded state.

In the cylinder body 25 at the second pump case 12B side, a suction/discharge port 252 is formed so as to communicate with the second suction-side air chamber 26B. The suction/discharge port 252 is connected to the air supply device 2 via the second solenoid valve the second electropneumatic regulator 52, and the mechanical regulator 3 (see FIG. 1). Accordingly, when the pressurized air is supplied from the air supply device 2 to the interior of the second suction-side air chamber 26B via the suction/discharge port 252, the second bellows 14 expands to a predetermined expanded state (hereinafter, simply referred to as "expanded state").

The expanded state of the second bellows 14 may be the most expanded state or may be a state before the most expanded state.

Because of the above configuration, the first pump case 12A, in which the first discharge-side air chamber 21A is formed, and the piston body 23 and the cylinder body 25 which form the first suction-side air chamber 26A, form a first driving unit (driving unit) 27 which causes the first bellows 13 to perform expansion/contraction operation continuously between the expanded state and the contracted state.

In addition, the second pump case 12B, in which the second discharge-side air chamber 21B is formed, and the piston body 23 and the cylinder body 25 which form the second suction-side air chamber 26B, form a second driving unit (driving unit) 28 which causes the second bellows 14 to perform expansion/contraction operation continuously between the expanded state and the contracted state.

[Detection Units]

A pair of a proximity sensor 29A and a proximity sensor 29B are mounted on the cylinder body 25 of the first driving unit 27. A detection plate 30 to be detected by each of the proximity sensors 29A and 29B is mounted on the piston body 23 of the first driving unit 27. The detection plate 30 reciprocates together with the piston body 23, whereby the detection plate 30 alternately comes close to the proximity sensors 29A and 29B.

The proximity sensor 29A is disposed at a position where the proximity sensor 29A detects the detection plate 30 when the first bellows 13 is in a mid-contraction state before the contracted state. The proximity sensor 29B is disposed at a position where the proximity sensor 29B detects the detection plate 30 when the first bellows 13 is in the expanded state. When the respective proximity sensors 29A and 29B detect the detection plate 30, the proximity sensors 29A and 29B output detection signals thereof to the control unit 6. The pair of proximity sensors 29A and 29B function as a first detection unit (detection unit) which detects an expanded/contracted state of the first bellows 13.

A pair of a proximity sensor 31A and a proximity sensor 31B are mounted on the cylinder body 25 of the second driving unit 28. A detection plate 32 to be detected by each of the proximity sensors 31A and 31B is mounted on the piston body 23 of the second driving unit 28. The detection plate 32 reciprocates together with the piston body 23, whereby the detection plate 32 alternately comes close to the proximity sensors 31A and 31B.

The proximity sensor 31A is disposed at a position where the proximity sensor 31A detects the detection plate 32 when the second bellows 14 is in a mid-contraction state before the contracted state. The proximity sensor 31B is disposed at a position where the proximity sensor 31B detects the detection plate 32 when the second bellows 14 is in the expanded state. When the respective proximity sensors 31A and 31B detect the detection plate 32, the proximity sensors 31A and 31B output detection signals thereof to the control unit 6. The pair of proximity sensors 31A and 31B function as a second detection unit (detection unit) which detects an expanded/contracted state of the second bellows 14.

Here, the "mid-contraction state" of the first bellows 13 (second bellows 14) means that a contraction progress position of the first bellows 13 (second bellows 14) is closer to a contraction end position (contracted state) than to a contraction start position (expanded state), and more specifically means a position where the first bellows 13 (second bellows 14) has contracted up to 50% to 90% of a contraction length from the expanded state to the contracted state.

[Pump Head]

The pump head 11 is formed from a fluorine resin such as PTFE or PFA. A suction passage 34 and a discharge passage 35 for the transport fluid are formed within the pump head 11. The suction passage 34 and the discharge passage 35 are opened in an outer peripheral surface of the pump head 11 and are respectively connected to a suction port and a discharge port (both are not shown) provided at the outer peripheral surface.

The suction port is connected to a storage tank for the transport fluid or the like, and the discharge port is connected to a transport destination for the transport fluid. In addition, the suction passage 34 and the discharge passage 35 each branch toward both right and left side surfaces of the pump head 11, and have suction openings 36 and discharge openings 37 which are opened in both right and left side surfaces of the pump head 11. Each suction opening 36 and each discharge opening 37 communicate with the interior of the bellows 13 or 14 via the check valves 15 and 16, respectively.

[Check Valves]

The check valves 15 and 16 are provided at each suction opening 36 and each discharge opening 37.

The check valve 15 (hereinafter, also referred to as "suction check valve") mounted at each suction opening 36 includes: a valve case 15*a*; a valve body 15*b* which is housed in the valve case 15*a*; and a compression coil spring 15*c* which biases the valve body 15*b* in a valve closing direction.

The valve case 15*a* is formed in a bottomed cylindrical shape. A through hole 15*d* is formed in a bottom wall of the valve case 15*a* so as to communicate with the interior of the bellows 13 or 14. The valve body 15*b* closes the suction opening 36 (performs valve closing) by the biasing force of the compression coil spring 15*c*, and opens the suction opening 36 (performs valve opening) when a back pressure generated by flow of the transport fluid occurring with expansion/contraction of the bellows 13 or 14 acts thereon.

Accordingly, the suction check valve 15 opens, when the bellows 13 or 14 at which the suction check valve 15 is disposed expands, to permit suction of the transport fluid in a direction from the suction passage 34 toward the interior of the bellows 13 or 14 (in one direction). In addition, the suction check valve 15 closes, when the bellows 13 or 14 at which the suction check valve 15 is disposed contracts, to block backflow of the transport fluid in a direction from the interior of the bellows 13 or 14 toward the suction passage 34 (in another direction).

The check valve 16 (hereinafter, also referred to as "discharge check valve") mounted at each discharge opening 37 includes: a valve case 16*a*; a valve body 16*b* which is housed in the valve case 16*a*; and a compression coil spring 16*c* which biases the valve body 16*b* in a valve closing direction.

The valve case 16*a* is formed in a bottomed cylindrical shape. A through hole 16*d* is formed in a bottom wall of the valve case 16*a* so as to communicate with the interior of the bellows 13 or 14. The valve body 16*b* closes the through hole 16*d* of the valve case 16*a* (performs valve closing) by the biasing force of the compression coil spring 16*c*, and opens the through hole 16*d* of the valve case 16*a* (performs valve opening) when a back pressure generated by flow of the transport fluid occurring with expansion/contraction of the bellows 13 or 14 acts thereon.

Accordingly, the discharge check valve 16 opens, when the bellows 13 or 14 at which the discharge check valve 16 is disposed contracts, to permit outflow of the transport fluid in a direction from the interior of the bellows 13 or 14 toward the discharge passage 35 (in one direction). In addition, the discharge check valve 16 closes, when the bellows 13 or 14 at which the discharge check valve 16 is disposed expands, to block backflow of the transport fluid in a direction from the discharge passage 35 toward the interior of the bellows 13 or 14 (in another direction).

[Operation of Bellows Pump]

Figure 3:
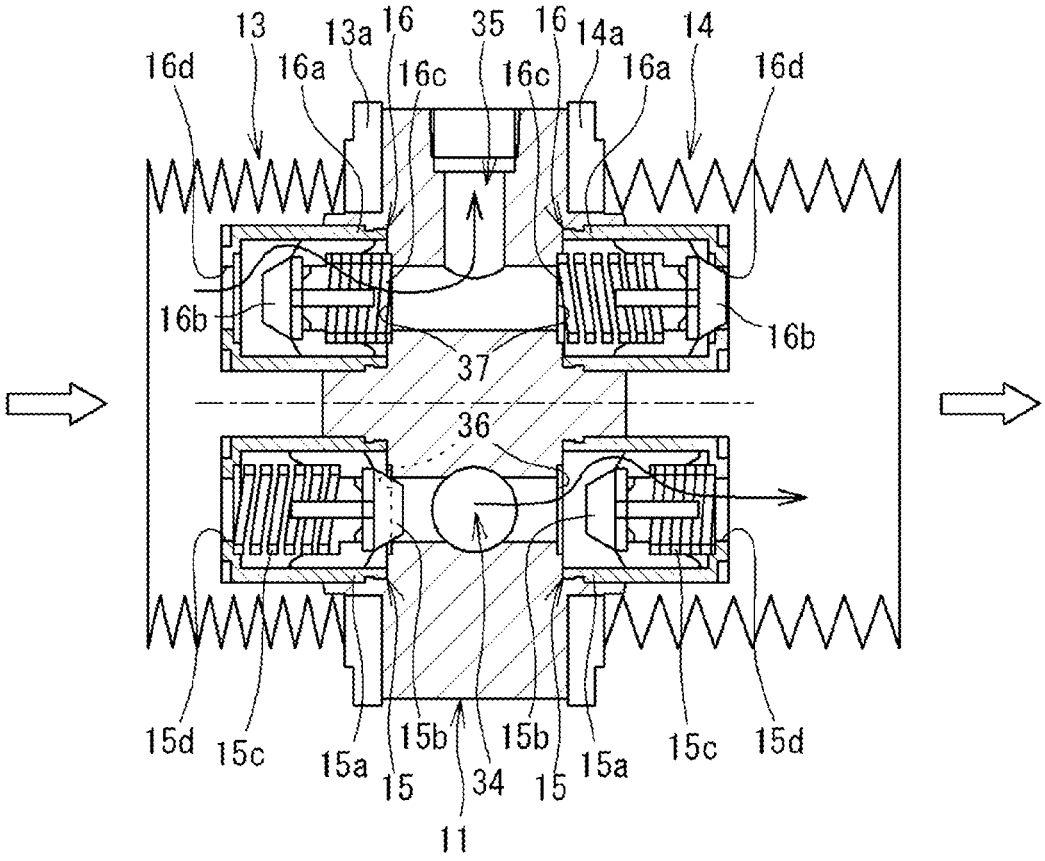
FIG. 3 is an explanatory diagram showing operation of the bellows pump.
Figure 4:
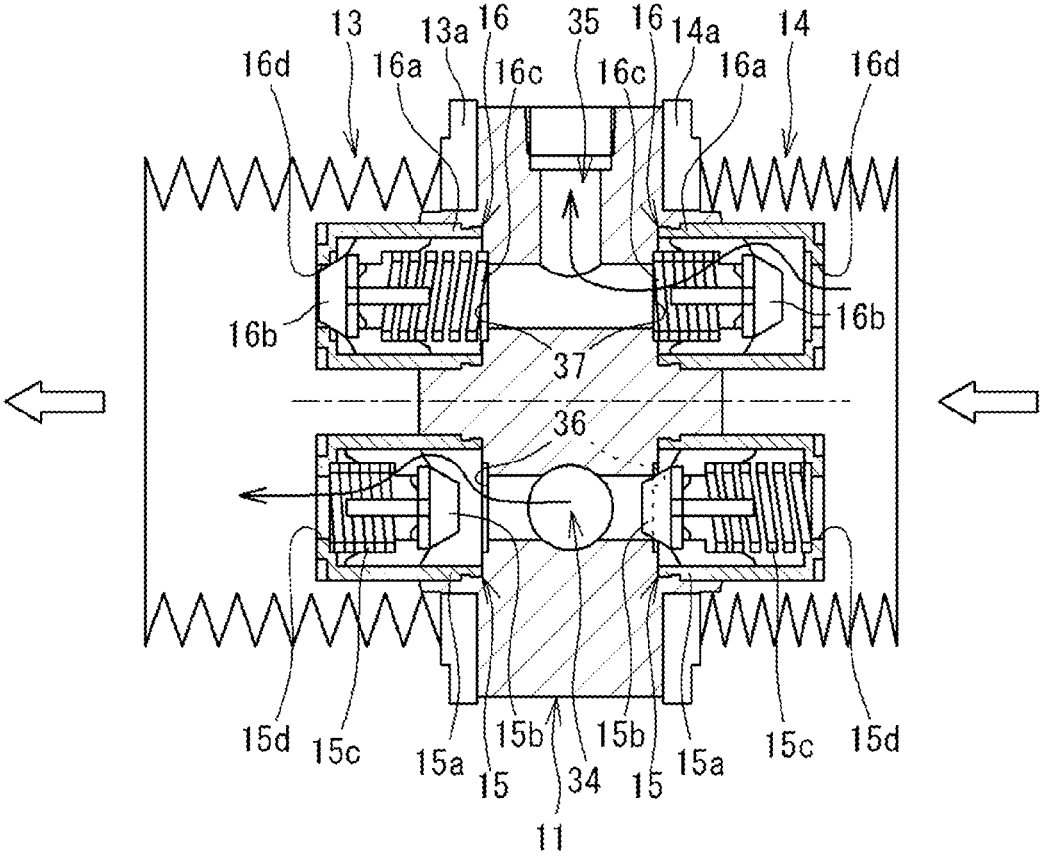
FIG. 4 is an explanatory diagram showing operation of the bellows pump.

Next, operation of the bellows pump 10 of the present embodiment will be described with reference to FIG. 3 and FIG. 4. In FIG. 3 and FIG. 4, the configurations of the first and second bellows 13 and 14 are shown in a simplified manner. As shown in FIG. 3, when the first bellows 13 contracts and the second bellows 14 expands, the respective valve bodies 15*b* and 16*b* of the suction check valve 15 and the discharge check valve 16 that are mounted at the left side of the pump head 11 in the drawing receive pressure from the transport fluid within the first bellows 13 and move to the right sides of the respective valve cases 15*a* and 16*a* in the drawing. Accordingly, the suction check valve 15 closes, and the discharge check valve 16 opens, so that the transport fluid within the first bellows 13 is discharged through the discharge passage 35 to the outside of the pump.

Meanwhile, the valve body 15*b* of the suction check valve 15 mounted at the right side of the pump head 11 in the drawing moves to the right side of the valve case 15*a* in the drawing due to a suction action by the second bellows 14. The valve body 16*b* of the discharge check valve 16 mounted at the right side of the pump head 11 in the drawing moves to the right side of the valve case 16*a* in the drawing due to a suction action by the second bellows 14 and a pressing action by the transport fluid discharged from the first bellows 13 to the discharge passage 35. Accordingly, the suction check valve 15 opens, and the discharge check valve 16 closes, so that the transport fluid is sucked from the suction passage 34 into the second bellows 14.

Next, as shown in FIG. 4, when the first bellows 13 expands and the second bellows 14 contracts, the respective valve bodies 15*b* and 16*b* of the suction check valve 15 and the discharge check valve 16 that are mounted at the right side of the pump head 11 in the drawing receive pressure from the transport fluid within the second bellows 14 and move to the left sides of the respective valve cases 15*a* and 16*a* in the drawing. Accordingly, the suction check valve 15 closes, and the discharge check valve 16 opens, so that the transport fluid within the second bellows 14 is discharged through the discharge passage 35 to the outside of the pump.

Meanwhile, the valve body 15*b* of the suction check valve 15 mounted at the left side of the pump head 11 in the drawing moves to the left side of the valve case 15*a* in the drawing due to a suction action by the first bellows 13. The valve body 16*b* of the discharge check valve 16 mounted at the left side of the pump head 11 in the drawing moves to the left side of the valve case 16*a* in the drawing due to a suction action by the first bellows 13 and a pressing action by the transport fluid discharged from the first bellows 13 to the discharge passage 35. Accordingly, the suction check valve 15 opens, and the discharge check valve 16 closes, so that the transport fluid is sucked from the suction passage 34 into the first bellows 13.

By repeatedly performing the above operation, the left and right bellows 13 and 14 can alternately suck and discharge the transport fluid.

[Solenoid Valves]

In FIG. 1, the first solenoid valve 4 is composed of, for example, a three-position solenoid switching valve including a pair of a solenoid 4*a* and a solenoid 4*b*. Each of the solenoids 4*a* and 4*b* is configured to be magnetized on the basis of a command signal received from the control unit 6. Accordingly, the first solenoid valve 4 is switched and controlled by the control unit 6. The first solenoid valve 4 switches between supply/discharge of the pressurized air to/from the first discharge-side air chamber 21A and supply/discharge of the pressurized air to/from the first suction-side air chamber 26A in the first driving unit 27.

Specifically, when the solenoid 4*a* is magnetized, the first solenoid valve 4 switches to a state where the pressurized air is supplied to the first discharge-side air chamber 21A and the pressurized air within the first suction-side air chamber 26A is discharged. In addition, when the solenoid 4*b* is magnetized, the first solenoid valve 4 switches to a state where the pressurized air within the first discharge-side air chamber 21A is discharged and the pressurized air is supplied to the first suction-side air chamber 26A.

The second solenoid valve 5 is composed of, for example, a three-position solenoid switching valve including a pair of a solenoid 5*a* and a solenoid 5*b*. Each of the solenoids 5*a* and 5*b* is configured to be magnetized upon reception of a command signal from the control unit 6. Accordingly, the second solenoid valve 5 is switched and controlled by the control unit 6. The second solenoid valve 5 switches between supply/discharge of the pressurized air to/from the second discharge-side air chamber 21B and supply/discharge of the pressurized air to/from the second suction-side air chamber 26B in the second driving unit 28.

Specifically, when the solenoid 5*a* is magnetized, the second solenoid valve 5 switches to a state where the pressurized air is supplied to the second discharge-side air chamber 21B and the pressurized air within the second suction-side air chamber 26B is discharged. In addition, when the solenoid 5*b* is magnetized, the second solenoid valve 5 switches to a state where the pressurized air within the second discharge-side air chamber 21B is discharged and the pressurized air is supplied to the second suction-side air chamber 26B.

Although each of the first and second solenoid valves 4 and 5 of the present embodiment is composed of the three-position solenoid switching valve, each of the first and second solenoid valves 4 and 5 may be a two-position solenoid switching valve which does not have a neutral position.

[Electropneumatic Regulators]

The first electropneumatic regulator 51 is disposed between the mechanical regulator 3 and the first solenoid valve 4. The first electropneumatic regulator 51 adjusts the air pressure of the pressurized air to be supplied to the first suction-side air chamber 26A of the first driving unit 27 and the air pressure of the pressurized air to be supplied to the first discharge-side air chamber 21A of the first driving unit 27.

The second electropneumatic regulator 52 is disposed between the mechanical regulator 3 and the second solenoid valve 5. The second electropneumatic regulator 52 adjusts the air pressure of the pressurized air to be supplied to the second suction-side air chamber 26B of the second driving unit 28 and the air pressure of the pressurized air to be supplied to the second discharge-side air chamber 21B of the second driving unit 28.

The electropneumatic regulators 51 and 52 only have to adjust at least the air pressure of the pressurized air to be supplied to the suction-side air chambers 26A and 26B. In addition, in the present embodiment, the electropneumatic regulators 51 and 52, which directly adjust the air pressure, are used as fluid pressure adjustment units, but the air pressure may be adjusted indirectly using an air flow rate adjusting valve which adjusts an air flow rate, or a device that adjusts the pressure or flow rate of a gas other than air (for example, nitrogen), a liquid, or the like may be used.

[Control Unit]

In FIG. 1 and FIG. 2, the control unit 6 is configured to include a computer having a CPU or the like. Each function of the control unit 6 is performed by the CPU executing a control program stored in a storage device of the computer. The control unit 6 performs drive control of the first driving unit 27 and the second driving unit 28 by switching the first solenoid valve 4 and the second solenoid valve 5 on the basis of the respective detection results of a first detection unit 29 and a second detection unit 31.

Specifically, the control unit 6 controls each drive of the first driving unit 27 and the second driving unit 28 on the basis of the respective detection results of the first detection unit 29 and the second detection unit 31 such that the second bellows 14 is caused to contract from the expanded state before the first bellows 13 comes into the contracted state and the first bellows 13 is caused to contract from the expanded state before the second bellows 14 comes into the contracted state.

By the control unit 6 performing drive control as described above, at a time of switching from contraction of one bellows out of the first bellows 13 and the second bellows 14 to expansion thereof (from discharge of the transport fluid to suction thereof), the other bellows has already contracted to discharge the transport fluid. Thus, great fall of the discharge pressure of the transport fluid at the above time can be reduced. As a result, pulsation at the discharge side of the bellows pump 10 can be reduced.

In the above drive control, for example, if the atmospheric temperature falls, the first bellows 13 and the second bellows 14 may become harder due to the influence thereof, so that each of the expansion times of the first bellows 13 and the second bellows 14 may become longer. In this case, the control unit 6 performs next pressure increase control and current-time pressure increase control for shortening each of the expansion times of the first bellows 13 and the second bellows 14.

Specifically, the control unit 6 performs a first determination of determining whether or not the second bellows 14 (first bellows) is in the expanded state when the first bellows 13 (second bellows 14) contracts to the mid-contraction state, on the basis of the respective detection results of the first detection unit 29 and the second detection unit 31. When the determination result of the first determination is negative (not in the expanded state), the control unit 6 performs next pressure increase control of controlling the second electropneumatic regulator 52 (first electropneumatic regulator 51) such that the air pressure of the pressurized air to be supplied to the second suction-side air chamber 26B (first suction-side air chamber 26A) at the next expansion of the second bellows 14 (first bellows 13) is increased. The degree of increase in the air pressure in the next pressure increase control is preferably +1 kPa to +50 kPa (more preferably +1 kPa to +20 kPa).

When the determination result of the first determination is negative (not in the expanded state) as described above, for the second bellows 14 (first bellows 13) which is expanding at the current time, the control unit 6 further performs current-time pressure increase control of controlling the second electropneumatic regulator 52 (first electropneumatic regulator 51) such that the air pressure of the pressurized air currently supplied to the second suction-side air chamber 26B (first suction-side air chamber 26A) is gradually increased. The degree of increase in the air pressure in the current-time pressure increase control is preferably +1 kPa to +100 kPa (more preferably +1 kPa to +30 kPa) every 1 msec to 100 msec (more preferably every 1 msec to 30 msec).

Meanwhile, in the above drive control, for example, if the atmospheric temperature rises, the first bellows 13 and the second bellows 14 may become softer due to the influence thereof, so that each of the expansion times of the first bellows 13 and the second bellows 14 may become shorter. In this case, the control unit 6 performs pressure decrease control for lengthening each of the expansion times of the first bellows 13 and the second bellows 14.

Specifically, the control unit 6 performs a second determination of determining whether or not the second bellows 14 (first bellows 13) has continued to be in the expanded state for a predetermined time or longer when the first bellows 13 (second bellows 14) contracts to the mid-contraction state, on the basis of the respective detection results of the first detection unit 29 and the second detection unit 31. The predetermined time is preferably set to a value of, for example, 500 msec (preferably 10 to 200 msec).

When the determination result of the second determination is positive (having continued to be in the expanded state for the predetermined time or longer), the control unit 6 performs pressure decrease control of controlling the second electropneumatic regulator 52 (first electropneumatic regulator 51) such that the air pressure of the pressurized air to be supplied to the second suction-side air chamber 26B (first suction-side air chamber 26A) at the next expansion of the second bellows 14 (first bellows 13) is decreased. The degree of decrease in the air pressure in the pressure decrease control is preferably −1 kPa to −50 kPa (more preferably −1 kPa to −20 kPa).

When the pressure decrease control has been performed, the air pressure of the pressurized air to be supplied to the second suction-side air chamber 26B (first suction-side air chamber 26A) may be decreased more than necessary. In this case, even when the expansion time of the second bellows 14 (first bellows 13) becomes excessively long and the first bellows 13 (second bellows 14) contracts to the contracted state, a situation in which the second bellows 14 (first bellows 13) does not reach the expanded state may occur. If such a situation occurs, the above drive control cannot be performed normally, so that pulsation at the discharge side of the bellows pump 10 deteriorates. Therefore, if the air pressure of the pressurized air to be supplied to the second suction-side air chamber 26B (first suction-side air chamber 26A) is decreased more than necessary by the pressure decrease control, the control unit 6 resets the lower limit of the range of air pressure adjustment by the second electropneumatic regulator 52 (first electropneumatic regulator 51) at the next expansion of the second bellows 14 (first bellows 13).

Specifically, the control unit 6 performs a third determination of determining whether or not the second bellows 14 (first bellows 13) is in the expanded state when the first bellows 13 (second bellows 14) contracts to the contracted state, on the basis of the respective detection results of the first detection unit 29 and the second detection unit 31. When the determination result of the third determination is negative (not in the expanded state), the control unit 6 sets the lower limit of the range of air pressure adjustment by the second electropneumatic regulator 52 (first electropneumatic regulator 51) at the next expansion of the second bellows 14 (first bellows 13) such that the lower limit is higher than the air pressure at the last expansion of the second bellows 14 (first bellows 13).

The degree of setting of the lower limit of the range of air pressure adjustment is preferably +1 kPa to +50 kPa (more preferably +5 kPa to +20 kPa). Needless to say, the upper limit of the range of air pressure adjustment is a fixed value, and the upper limit is not changed even if the lower limit is reset. The lower limit thus reset is also applied as the lower limit of the range of air pressure adjustment by the second electropneumatic regulator 52 (first electropneumatic regulator 51) at expansion of the second bellows 14 (first bellows 13) subsequent to the next expansion thereof.

If the air pressure of the pressurized air to be supplied to the second suction-side air chamber 26B (first suction-side air chamber 26A) is decreased more than necessary by the pressure decrease control, the control unit 6 further performs the above current-time pressure increase control. Specifically, when the determination result of the third determination is negative (not in the expanded state), for the second bellows 14 (first bellows 13) which is expanding at the current time, the control unit 6 further performs current-time pressure increase control of controlling the second electropneumatic regulator 52 (first electropneumatic regulator 51) such that the air pressure of the pressurized air currently supplied to the second suction-side air chamber 26B (first suction-side air chamber 26A) is gradually increased.

[Specific Example of Next Pressure Increase Control]

Figure 5:
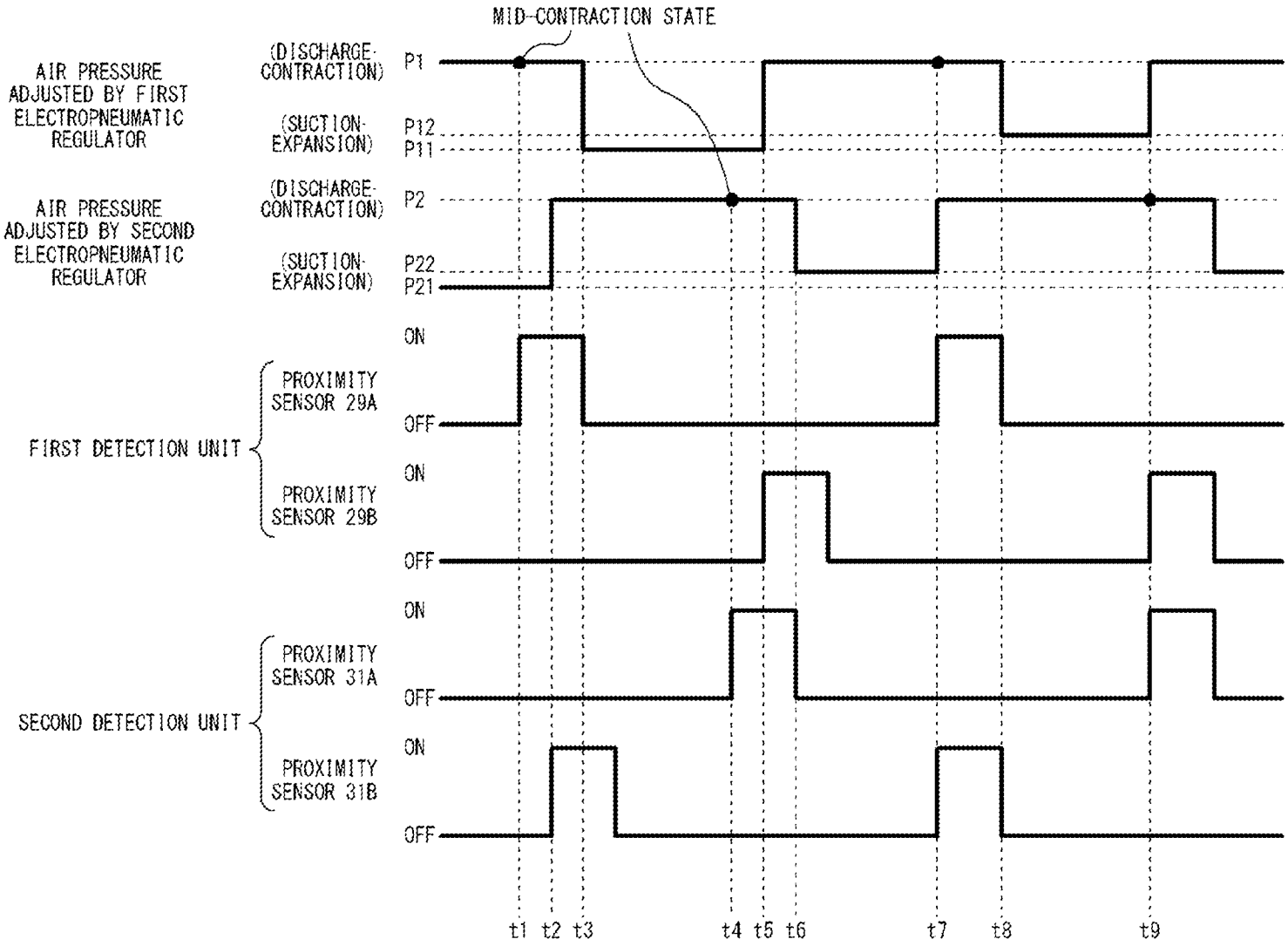
FIG. 5 is a time chart showing an example of next pressure increase control.

FIG. 5 is a time chart showing an example of next pressure increase control performed by the control unit 6 during drive control. Hereinafter, the drive control and the next pressure increase control executed by the control unit 6 will be described with reference to FIG. 1 and FIG. 5. Here, a description from a state where the first bellows 13 is in the middle of contraction operation (discharge) and the second bellows 14 is in the middle of expansion operation (suction) will be given.

At time t1 at which the proximity sensor 29A detects the mid-contraction state of the first bellows 13 (is turned ON), the control unit 6 determines whether or not the proximity sensor 31B has detected the expanded state of the second bellows 14 (been turned ON) (first determination). Here, at time t1, the proximity sensor 31B has not detected the expanded state of the second bellows 14 (has been OFF), and thus the control unit 6 determines that the proximity sensor 31B has not been turned ON. Due to this determination result, the control unit 6 executes the next pressure increase control at the next expansion of the second bellows 14 (time t6 to time t7) as described later.

When the control unit 6 determines that the proximity sensor 31B has not been turned ON, the control unit 6 waits until the proximity sensor 31B is turned ON. Then, at time t2 at which the proximity sensor 31B is turned ON, the control unit 6 demagnetizes the solenoid 5*b* of the second solenoid valve 5 and magnetizes the solenoid 5*a*. When the control unit 6 determines at time t1 that the proximity sensor 31B has been turned ON, the control unit 6 immediately demagnetizes the solenoid 5*b* of the second solenoid valve 5 and magnetizes the solenoid 5*a*.

When the solenoid 5*a* of the second solenoid valve 5 is magnetized, the pressurized air generated by the air supply device 2 is supplied to the second discharge-side air chamber 21B of the second driving unit 28 via the mechanical regulator 3, the second electropneumatic regulator 52, and the second solenoid valve 5. At this time, the control unit 6 controls the second electropneumatic regulator 52 such that the air pressure of the pressurized air to be supplied to the second discharge-side air chamber 21B reaches a predetermined value P2. Accordingly, the second bellows 14 starts contraction operation from the expanded state before the first bellows 13 comes into the contracted state.

After the second bellows 14 starts contraction operation, at time t3 at which a predetermined calculation time elapses from time t1 at which the proximity sensor 29A is turned ON, the control unit 6 determines that the first bellows 13 comes into the contracted state. Then, the control unit 6 demagnetizes the solenoid 4*a* of the first solenoid valve 4 and magnetizes the solenoid 4*b*.

When the solenoid 4*b* of the first solenoid valve 4 is magnetized, the pressurized air generated by the air supply device 2 is supplied to the first suction-side air chamber 26A of the first driving unit 27 via the mechanical regulator 3, the first electropneumatic regulator 51, and the first solenoid valve 4. At this time, the control unit 6 controls the first electropneumatic regulator 51 such that the air pressure of the pressurized air to be supplied to the first suction-side air chamber 26A reaches a predetermined value P11. Accordingly, the first bellows 13 starts expansion operation from the contracted state.

Next, at time t4 at which the proximity sensor 31A detects the mid-contraction state of the second bellows 14 (is turned ON), the control unit 6 determines whether or not the proximity sensor 29B has detected the expanded state of the first bellows 13 (been turned ON) (first determination). Here, at time t4, the proximity sensor 29B has not detected the expanded state of the first bellows 13 (has been OFF), so that the control unit 6 determines that the proximity sensor 29B has not been turned ON. Due to this determination result, the control unit 6 executes next pressure increase control at the next expansion of the first bellows 13 (time t8 to time t9) as described later.

When the control unit 6 determines that the proximity sensor 29B has not been turned ON, the control unit 6 waits until the proximity sensor 29B is turned ON. Then, at time t5 at which the proximity sensor 29B is turned ON, the control unit 6 demagnetizes the solenoid 4*b* of the first solenoid valve 4 and magnetizes the solenoid 4*a*. When the control unit 6 determines at time t4 that the proximity sensor 29B has been turned ON, the control unit 6 immediately demagnetizes the solenoid 4*b* of the first solenoid valve 4 and magnetizes the solenoid 4*a*.

When the solenoid 4*a* of the first solenoid valve 4 is magnetized, the pressurized air generated by the air supply device 2 is supplied to the first discharge-side air chamber 21A of the first driving unit 27 via the mechanical regulator 3, the first electropneumatic regulator 51, and the first solenoid valve 4. At this time, the control unit 6 controls the first electropneumatic regulator 51 such that the air pressure of the pressurized air to be supplied to the first discharge-side air chamber 21A reaches a predetermined value P1. Accordingly, the first bellows 13 starts contraction operation from the expanded state before the second bellows 14 comes into the contracted state.

After the first bellows 13 starts contraction operation, at time t6 at which a predetermined time elapses from the time at which the proximity sensor 31A is turned ON, the control unit 6 determines that the second bellows 14 comes into the contracted state. Then, the control unit 6 demagnetizes the solenoid 5*a* of the second solenoid valve 5 and magnetizes the solenoid 5*b*.

When the solenoid 5*b* of the second solenoid valve 5 is magnetized, the pressurized air generated by the air supply device 2 is supplied to the second suction-side air chamber 26B of the second driving unit 28 via the mechanical regulator 3, the second electropneumatic regulator 52, and the second solenoid valve 5. At this time, since the determination result of the first determination performed at time t1 is negative (it is determined that the proximity sensor 31B has not been turned ON), the control unit 6 executes next pressure increase control of controlling the second electropneumatic regulator 52 such that the air pressure of the pressurized air to be supplied to the second suction-side air chamber 26B is increased.

Specifically, the control unit 6 controls the second electropneumatic regulator 52 such that the air pressure of the pressurized air to be supplied to the second suction-side air chamber 26B reaches a value P22 which is higher than a value P21 at the last time (before time t2). Accordingly, the second bellows 14 starts expansion operation from the contracted state. The expansion speed thereof becomes higher than the expansion speed of the second bellows 14 at the last time.

Next, at time t7 at which the proximity sensor 29A detects the mid-contraction state of the first bellows 13 (is turned ON), the control unit 6 determines whether or not the proximity sensor 31B has detected the expanded state of the second bellows 14 (been turned ON) (first determination). Here, the expansion speed of the second bellows 14 becomes higher as described above, shortening the expansion time of the second bellows 14, whereby the second bellows 14 reaches the expanded state at time t7. Therefore, at time t7, the proximity sensor 31B detects the expanded state of the second bellows 14, and thus the control unit 6 determines that the proximity sensor 31B has been turned ON. Due to this determination result, the control unit 6 does not execute the next pressure increase control at the next expansion of the second bellows 14.

When the control unit 6 determines that the proximity sensor 31B has been turned ON, the control unit 6 demagnetizes the solenoid 5*b* of the second solenoid valve 5 and magnetizes the solenoid 5*a*. When the solenoid 5*a* of the second solenoid valve 5 is magnetized, the second bellows 14 starts contraction operation from the expanded state before the first bellows 13 comes into the contracted state (while the first bellows 13 is in the mid-contraction state) as described above.

After the second bellows 14 starts contraction operation, at time t8 at which a predetermined calculation time elapses from time t7 at which the proximity sensor 29A is turned ON, the control unit 6 determines that the first bellows 13 comes into the contracted state, and the control unit 6 demagnetizes the solenoid 4*a* of the first solenoid valve 4 and magnetizes the solenoid 4*b*. When the solenoid 4*b* of the first solenoid valve 4 is magnetized, the pressurized air generated by the air supply device 2 is supplied to the first suction-side air chamber 26A of the first driving unit 27 as described above.

At this time, since the determination result of the first determination performed at time t4 is negative (it is determined that the proximity sensor 29B has not been turned ON), the control unit 6 executes next pressure increase control of controlling the first electropneumatic regulator 51 such that the air pressure of the pressurized air to be supplied to the first suction-side air chamber 26A is increased.

Specifically, the control unit 6 controls the first electropneumatic regulator 51 such that the air pressure of the pressurized air supplied to the first suction-side air chamber 26A reaches a value P12 which is higher than the value P11 at the last time (time t3 to time t5). Accordingly, the first bellows 13 starts expansion operation from the contracted state. The expansion speed thereof becomes higher than the expansion speed at the last expansion operation of the first bellows 13.

Next, at time t9 at which the proximity sensor 31A detects the mid-contraction state of the second bellows 14 (is turned ON), the control unit 6 determines whether or not the proximity sensor 29B has detected the expanded state of the first bellows 13 (been turned ON) (first determination). Here, the expansion speed of the first bellows 13 becomes higher as described above, shortening the expansion time of the first bellows 13, whereby the first bellows 13 reaches the expanded state at time t9. Therefore, at time t9, the proximity sensor 29B detects the expanded state of the first bellows 13, and thus the control unit 6 determines that the proximity sensor 29B has been turned ON. Due to this determination result, the control unit 6 does not execute the next pressure increase control at the next expansion of the first bellows 13.

When the control unit 6 determines that the proximity sensor 29B has been turned ON, the control unit 6 demagnetizes the solenoid 4*b* of the first solenoid valve 4 and magnetizes the solenoid 4*a*. When the solenoid 4*a* of the first solenoid valve 4 is magnetized, the first bellows 13 starts contraction operation from the expanded state before the second bellows 14 comes into the contracted state (while the second bellows 14 is in the mid-contraction state) as described above.

[Specific Example of Pressure Decrease Control]

Figure 6:
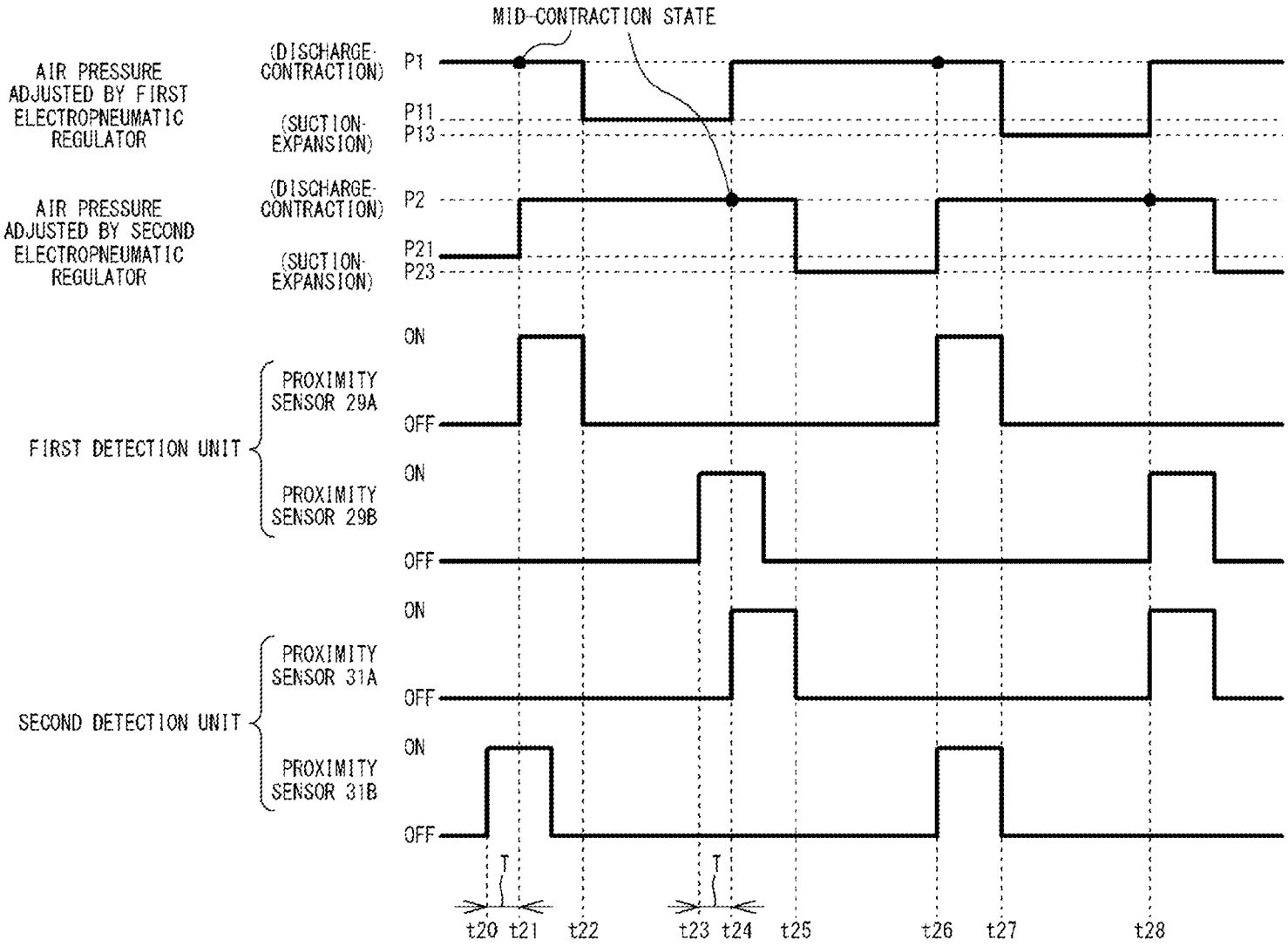
FIG. 6 is a time chart showing an example of pressure decrease control.

FIG. 6 is a time chart showing an example of pressure decrease control performed by the control unit 6 during drive control. Hereinafter, the pressure decrease control executed by the control unit 6 will be described with reference to FIG. 1 and FIG. 6. Here, as in FIG. 5, a description from a state where the first bellows 13 is in the middle of contraction operation (discharge) and the second bellows 14 is in the middle of expansion operation (suction) will be given.

The control unit 6 determines whether or not the proximity sensor 31B detects the expanded state of the second bellows 14 (is turned ON) before the proximity sensor 29A detects the mid-contraction state of the first bellows 13 (is turned ON). Here, at time t20 before the first bellows 13 reaches the mid-contraction state, the proximity sensor 31B detects the expanded state of the second bellows 14, and thus the control unit 6 determines that the proximity sensor 31B is turned ON.

When the control unit 6 determines that the proximity sensor 31B is turned ON, at time t21 at which the proximity sensor 29A detects the mid-contraction state of the first bellows 13, the control unit 6 further determines whether or not a predetermined time T or longer has elapsed from time t20 at which the proximity sensor 31B detects the expanded state of the second bellows 14 (second determination). Here, at time t21, the predetermined time T elapses, and thus the control unit 6 determines that the predetermined time T or longer has elapsed from time t20. Due to this determination result, the control unit 6 executes pressure decrease control at the next expansion of the second bellows 14 (time t25 to time t26) as described later.

At time t21 at which the proximity sensor 29A is turned ON, the control unit 6 demagnetizes the solenoid 5*b* of the second solenoid valve 5 and magnetizes the solenoid 5*a*. When the solenoid 5*a* of the second solenoid valve 5 is magnetized, the second bellows 14 starts contraction operation from the expanded state before the first bellows 13 comes into the contracted state (while the first bellows 13 is in the mid-contraction state) as described above.

After the second bellows 14 starts contraction operation, at time t22 at which a predetermined calculation time elapses from time t21 at which the proximity sensor 29A is turned ON, the control unit 6 determines that the first bellows 13 comes into the contracted state. Then, the control unit 6 demagnetizes the solenoid 4*a* of the first solenoid valve 4 and magnetizes the solenoid 4*b*. When the solenoid 4*b* of the first solenoid valve 4 is magnetized, the first bellows 13 starts expansion operation from the contracted state as described above.

Next, the control unit 6 determines whether or not the proximity sensor 29B detects the expanded state of the first bellows 13 (is turned ON) before the proximity sensor 31A detects the mid-contraction state of the second bellows 14 (is turned ON). Here, at time t23 before the second bellows 14 reaches the mid-contraction state, the proximity sensor 29B detects the expanded state of the first bellows 13, and thus the control unit 6 determines that the proximity sensor 29B is turned ON.

When the control unit 6 determines that the proximity sensor 29B is turned ON, at time t24 at which the proximity sensor 31A detects the mid-contraction state of the second bellows 14, the control unit 6 further determines whether or not the predetermined time T or longer has elapsed from time t23 at which the proximity sensor 29B detects the expanded state of the second bellows 14 (second determination). Here, at time t24, the predetermined time T elapses, and thus the control unit 6 determines that the predetermined time T or longer has elapsed from time t23. Due to this determination result, the control unit 6 executes pressure decrease control at the next expansion of the first bellows 13 (time t27 to time t28) as described later.

At time t24 at which the proximity sensor 31A is turned ON, the control unit 6 demagnetizes the solenoid 4*b* of the first solenoid valve 4 and magnetizes the solenoid 4*a*. When the solenoid 4*a* of the first solenoid valve 4 is magnetized, the first bellows 13 starts contraction operation from the expanded state before the second bellows 14 comes into the contracted state (while the second bellows 14 is in the mid-contraction state) as described above.

After the first bellows 13 starts contraction operation, at time t25 at which a predetermined calculation time elapses from time t24 at which the proximity sensor 31A is turned ON, the control unit 6 determines that the second bellows 14 comes into the contracted state. Then, the control unit 6 demagnetizes the solenoid 5*a* of the second solenoid valve 5 and magnetizes the solenoid 5*b*. When the solenoid 5*b* of the second solenoid valve 5 is magnetized, the pressurized air generated by the air supply device 2 is supplied to the second suction-side air chamber 26B of the second driving unit 28 as described above.

At this time, since the determination result of the second determination performed at time t21 is positive (it is determined that the predetermined time T or longer has elapsed from time t20 at which the proximity sensor 31B is turned ON), the control unit 6 executes pressure decrease control of controlling the second electropneumatic regulator 52 such that the air pressure of the pressurized air to be supplied to the second suction-side air chamber 26B is decreased.

Specifically, the control unit 6 controls the second electropneumatic regulator 52 such that the air pressure of the pressurized air to be supplied to the second suction-side air chamber 26B reaches a value P23 which is lower than a value P21 at the last time (before time t21). Accordingly, the second bellows 14 starts expansion operation from the contracted state. The expansion speed thereof becomes lower than the expansion speed at the last expansion operation of the second bellows 14.

Next, the control unit 6 determines whether or not the proximity sensor 31B detects the expanded state of the second bellows 14 (is turned ON) before the proximity sensor 29A detects the mid-contraction state of the first bellows 13 (is turned ON). Here, the expansion speed of the second bellows 14 becomes lower as described above, lengthening the expansion time of the second bellows 14, whereby the second bellows 14 reaches the expanded state at time t26 at which the first bellows 13 reaches the mid-contraction state.

Therefore, since the proximity sensor 31B does not detect the expanded state of the second bellows 14 (is OFF) before the first bellows 13 reaches the mid-contraction state, the control unit 6 determines that the proximity sensor 31B has not been turned ON. Due to this determination result, at time t26 at which the first bellows 13 reaches the mid-contraction state, the second determination by the control unit 6 is not performed, and thus the pressure decrease control is not executed at the next expansion of the second bellows 14.

At time t26 at which the proximity sensor 31B is turned ON, the control unit 6 demagnetizes the solenoid 5*b* of the second solenoid valve 5 and magnetizes the solenoid 5*a*. When the solenoid 5*a* of the second solenoid valve 5 is magnetized, the second bellows 14 starts contraction operation from the expanded state before the first bellows 13 comes into the contracted state (while the first bellows 13 is in the mid-contraction state) as described above.

After the second bellows 14 starts contraction operation, at time t27 at which a predetermined calculation time elapses from time t26 at which the proximity sensor 29A is turned ON, the control unit 6 determines that the first bellows 13 comes into the contracted state. Then, the control unit 6 demagnetizes the solenoid 4*a* of the first solenoid valve 4 and magnetizes the solenoid 4*b*. When the solenoid 4*b* of the first solenoid valve 4 is magnetized, the pressurized air generated by the air supply device 2 is supplied to the first suction-side air chamber 26A of the first driving unit 27 as described above.

At this time, since the determination result of the second determination performed at time t24 is positive (it is determined that the predetermined time T or longer has elapsed from time t23 at which the proximity sensor 29B is turned ON), the control unit 6 executes pressure decrease control of controlling the first electropneumatic regulator 51 such that the air pressure of the pressurized air to be supplied to the first suction-side air chamber 26A is decreased.

Specifically, the control unit 6 controls the first electropneumatic regulator 51 such that the air pressure of the pressurized air to be supplied to the first suction-side air chamber 26A reaches a value P13 which is lower than a value P11 at the last time (time t22 to time t24). Accordingly, the first bellows 13 starts expansion operation from the contracted state. The expansion speed thereof becomes lower than the expansion speed at the last expansion operation of the first bellows 13.

Next, the control unit 6 determines whether or not the proximity sensor 29B detects the expanded state of the first bellows 13 (is turned ON) before the proximity sensor 31A detects the mid-contraction state of the second bellows 14 (is turned ON). Here, the expansion speed of the first bellows 13 becomes lower as described above, lengthening the expansion time of the first bellows 13, whereby the first bellows 13 reaches the expanded state at time t28 at which the second bellows 14 reaches the mid-contraction state.

Therefore, since the proximity sensor 29B does not detect the expanded state of the first bellows 13 (is OFF) before the second bellows 14 reaches the mid-contraction state, the control unit 6 determines that the proximity sensor 29B has not been turned ON. Due to this determination result, at time t28 at which the second bellows 14 reaches the mid-contraction state, the second determination by the control unit 6 is not performed, and thus the pressure decrease control is not executed at the next expansion of the first bellows 13.

[Specific Example of Resetting of Lower Limit]

Figure 7:
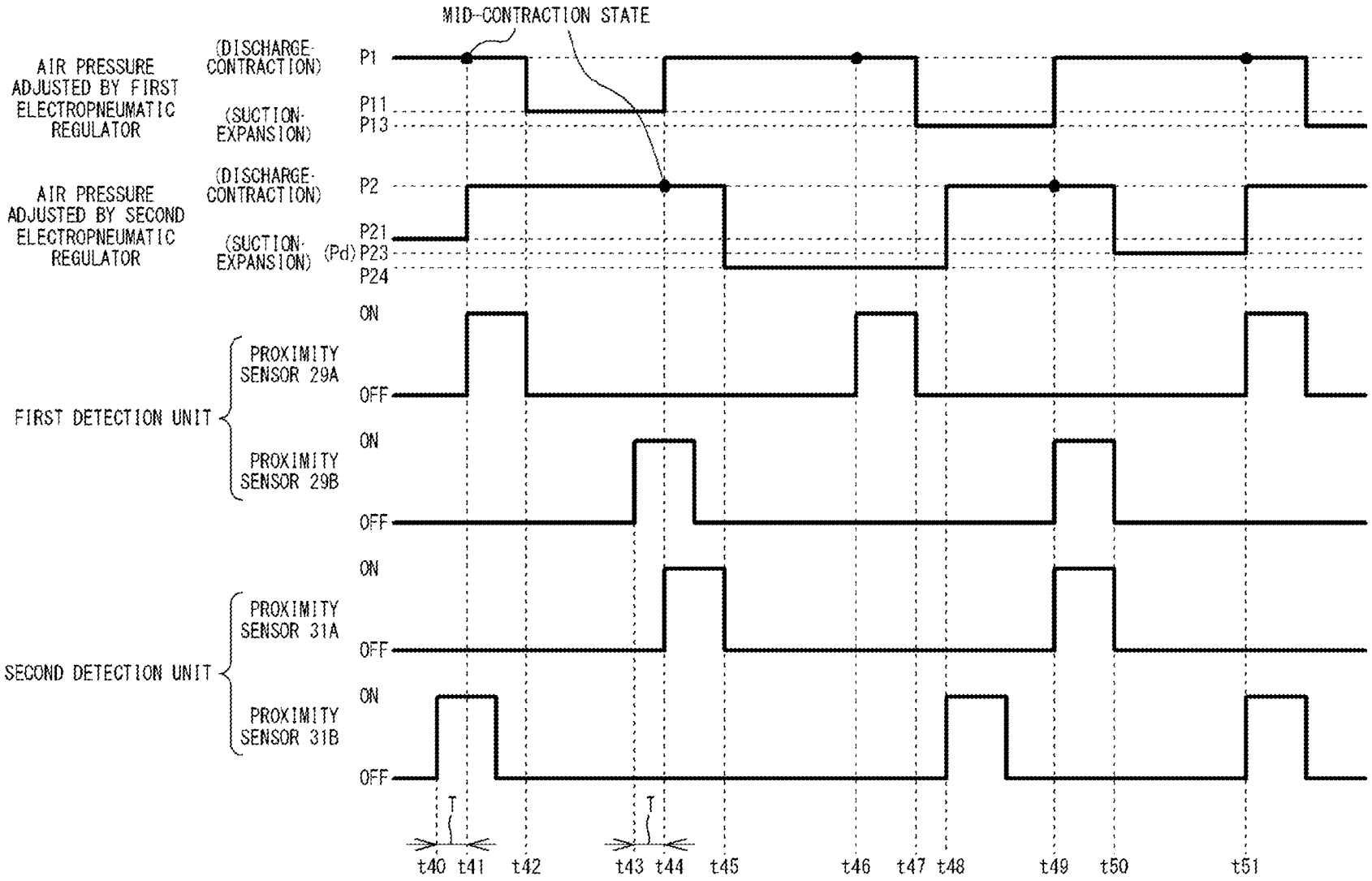
FIG. 7 is a time chart showing an example of resetting the lower limit of a range of air pressure adjustment by an electropneumatic regulator.

FIG. 7 is a time chart showing an example of resetting the lower limit of the range of air pressure adjustment by the electropneumatic regulator 51, 52 after pressure decrease control is performed by the control unit 6. Hereinafter, resetting of the lower limit executed by the control unit 6 will be described with reference to FIG. 1 and FIG. 7. Control performed from time t40 to time t44 in FIG. 7 is substantially the same as the control performed from time t20 to time t24 in FIG. 6, and thus the description thereof is omitted.

At time t45 at which a predetermined calculation time elapses from time t44 at which the proximity sensor 31A is turned ON, the control unit 6 determines that the second bellows 14 comes into the contracted state. Then, the control unit 6 demagnetizes the solenoid 5*a* of the second solenoid valve 5 and magnetizes the solenoid 5*b*. When the solenoid 5*b* of the second solenoid valve 5 is magnetized, the pressurized air generated by the air supply device 2 is supplied to the second suction-side air chamber 26B of the second driving unit 28 as described above.

At this time, since the determination result of the second determination performed at time t41 is positive (it is determined that a predetermined time T or longer has elapsed from the time t40 at which the proximity sensor 31B is turned ON), the control unit 6 executes pressure decrease control of controlling the second electropneumatic regulator 52 such that the air pressure of the pressurized air to be supplied to the second suction-side air chamber 26B is decreased.

Specifically, the control unit 6 controls the second electropneumatic regulator 52 such that the air pressure of the pressurized air to be supplied to the second suction-side air chamber 26B reaches a value P24 which is lower than a value P21 at the last time (before time t41). Accordingly, the second bellows 14 starts expansion operation from the contracted state. The expansion speed thereof becomes lower than the expansion speed at the last expansion operation of the second bellows 14.

Next, the control unit 6 determines whether or not the proximity sensor 31B detects the expanded state of the second bellows 14 (is turned ON) before the proximity sensor 29A detects the mid-contraction state of the first bellows 13 (is turned ON). Here, the expansion speed of the second bellows 14 becomes lower as described above, lengthening the expansion time of the second bellows 14, whereby the second bellows 14 is in the middle of expansion operation even at time t46 at which the first bellows 13 reaches the mid-contraction state.

Therefore, since the proximity sensor 31B does not detect the expanded state of the second bellows 14 (is OFF) before the first bellows 13 reaches the mid-contraction state, the control unit 6 determines that the proximity sensor 31B has not been turned ON. Due to this determination result, at time t46 at which the first bellows 13 reaches the mid-contraction state, the second determination by the control unit 6 is not performed, and thus the pressure decrease control is not executed at the next expansion of the second bellows 14.

Next, at time t46 at which the proximity sensor 29A detects the mid-contraction state of the first bellows 13 (is turned ON), the control unit 6 determines whether the proximity sensor 31B has detected the expanded state of the second bellows 14 (been turned ON) (first determination). Here, at time t46, the proximity sensor 31B has not detected the expanded state of the second bellows 14 (has been OFF), and thus the control unit 6 determines that the proximity sensor 31B has not been turned ON. Due to this determination result, the control unit 6 executes the next pressure increase control at the next expansion of the second bellows 14 (time t50 to time t51) as described later.

When the control unit 6 determines that the proximity sensor 31B has not been turned ON, the control unit 6 waits until the proximity sensor 31B is turned ON (until the second bellows 14 comes into the expanded state) or waits until time t47 at which a predetermined calculation time elapses from time t46 at which the proximity sensor 29A is turned ON (until the first bellows 13 comes into the contracted state). Here, the expansion speed of the second bellows 14 becomes lower as described above, excessively lengthening the expansion time of the second bellows 14, whereby time t47 at which the first bellows 13 comes into the contracted state is reached before the second bellows 14 reaches the expanded state.

At time t47 at which the first bellows 13 reaches the contracted state, the control unit 6 demagnetizes the solenoid 4*a* of the first solenoid valve 4 and magnetizes the solenoid 4*b*. When the solenoid 4*b* of the first solenoid valve 4 is magnetized, the first bellows 13 starts expansion operation from the contracted state as described above. The drive control and the pressure decrease control of the first bellows 13 by the control unit 6 at and after time t47 are the same as those at and after time t27 in FIG. 6, and thus the description thereof is omitted.

At time t47 at which the first bellows 13 reaches the contracted state, the control unit 6 further determines whether or not the proximity sensor 31B has detected the expanded state of the second bellows 14 (been turned ON) (third determination). Here, at time t47, the second bellows 14 has not reached the expanded state as described above, and thus the control unit 6 determines that the proximity sensor 31B has not been turned ON. Due to this determination result, the control unit 6 resets the lower limit of the range of air pressure adjustment by the second electropneumatic regulator 52 at the next expansion of the second bellows 14 (time t50 to time t51) as described later.

Next, at time t48 at which the proximity sensor 31B detects the expanded state of the second bellows 14, the control unit 6 demagnetizes the solenoid 5*b* of the second solenoid valve 5 and magnetizes the solenoid 5*a*. When the solenoid 5*a* of the second solenoid valve 5 is magnetized, the second bellows 14 starts contraction operation from the expanded state while the first bellows 13 is in the mid-expansion state as described above. Thereafter, at time t50 at which a predetermined calculation time elapses from time t49 at which the proximity sensor 31A detects the mid-contraction state of the second bellows 14 (is turned ON), the control unit 6 demagnetizes the solenoid 5*a* of the second solenoid valve 5 and magnetizes the solenoid 5*b*. When the solenoid 5*b* of the second solenoid valve 5 is magnetized, the pressurized air generated by the air supply device 2 is supplied to the second suction-side air chamber 26B of the second driving unit 28 as described above.

At this time, since the determination result of the first determination performed at time t46 is negative (it is determined that the proximity sensor 31B has not been turned ON), the control unit 6 executes next pressure increase control of controlling the second electropneumatic regulator 52 such that the air pressure of the pressurized air to be supplied to the second suction-side air chamber 26B is increased.

Specifically, first, the control unit 6 determines a degree of increase in the air pressure such that the value of the air pressure of the pressurized air to be supplied to the second suction-side air chamber 26B is higher than the value P24 of the air pressure of the pressurized air supplied to the second suction-side air chamber 26B at the last expansion of the second bellows 14 (time t45 to time t48). Here, for example, the control unit 6 determines the degree of increase such that a value P23 which is higher than the value P24 of the air pressure after pressure decrease control and lower than the value P21 of the air pressure before pressure decrease control is reached. Then, the control unit 6 controls the second electropneumatic regulator 52 such that the air pressure of the pressurized air to be supplied to the second suction-side air chamber 26B reaches the determined value P23. Accordingly, the second bellows 14 starts expansion operation from the contracted state. The expansion speed thereof becomes higher than the expansion speed at the last expansion operation of the second bellows 14.

Furthermore, since the determination result of the third determination performed at time t47 is negative (it is determined that the proximity sensor 31B has not been turned ON), the control unit 6 resets the lower limit of the range of air pressure adjustment by the second electropneumatic regulator 52.

Specifically, the control unit 6 sets a lower limit Pd of the range of air pressure adjustment by the second electropneumatic regulator 52 to an air pressure (here, the value P23) higher than the value P24 of the air pressure of the pressurized air supplied to the second suction-side air chamber 26B as a result of the pressure decrease control at the last expansion of the second bellows 14 (time t45 to time t48). Preferably, the lower limit is reset before control of the second electropneumatic regulator 52 is started in the next pressure increase control.

Next, at time t51 at which the proximity sensor 29A detects the mid-contraction state of the first bellows 13 (is turned ON), the control unit 6 determines whether or not the proximity sensor 31B has detected the expanded state of the second bellows 14 (been turned ON) (first determination). Here, the expansion speed of the second bellows 14 becomes higher as described above, shortening the expansion time of the second bellows 14, whereby the second bellows 14 reaches the expanded state at time t51. Therefore, at time t51, the proximity sensor 31B detects the expanded state of the second bellows 14, and thus the control unit 6 determines that the proximity sensor 31B has been turned ON. Due to this determination result, the control unit 6 does not execute the next pressure increase control at the next expansion of the second bellows 14.

Also, at the next and subsequent expansion of the second bellows 14, the lower limit Pd reset as described above is applied as the lower limit of the range of air pressure adjustment by the second electropneumatic regulator 52. Therefore, even when the pressure decrease control is executed at the next and subsequent expansion of the second bellows 14, the air pressure decreased by the pressure decrease control does not become lower than the lower limit Pd.

In the control example in FIG. 7, the lower limit of the range of air pressure adjustment by the second electropneumatic regulator 52 is reset at the next expansion of the second bellows 14 (time t50 to time t51) on the basis of the determination result of the third determination performed at time t47. However, the lower limit may be reset at the expansion of the second bellows 14 immediately after the next time without being reset at the next expansion of the second bellows 14. This is because, at the next expansion of the second bellows 14, the next pressure increase control is executed as described above, and the air pressure is increased by the second electropneumatic regulator 52 even if the lower limit is not reset.

When the lower limit is reset at the expansion of the second bellows 14 immediately after the next time, the reset lower limit Pd is applied as the lower limit of the range of air pressure adjustment by the second electropneumatic regulator 52 at expansion of the second bellows 14 subsequent to the expansion thereof immediately after the next time. Therefore, even when the pressure decrease control is executed at the expansion of the second bellows 14 subsequent to the expansion thereof immediately after the next time, the air pressure decreased by the pressure decrease control does not become lower than the lower limit Pd. The lower limit may be reset at the expansion of the second bellows 14 subsequent to the expansion thereof immediately after the next time without being reset at the next expansion of the second bellows 14 and the expansion of the second bellows 14 immediately after the next time.

In the control example in FIG. 7, the case of resetting the lower limit of the range of air pressure adjustment by the second electropneumatic regulator 52 has been described. The case of resetting the lower limit of the range of air pressure adjustment by the first electropneumatic regulator 51 is the same as described above, and thus the description thereof is omitted.

[Specific Example 1 of Current-Time Pressure Increase Control]

Figure 8:
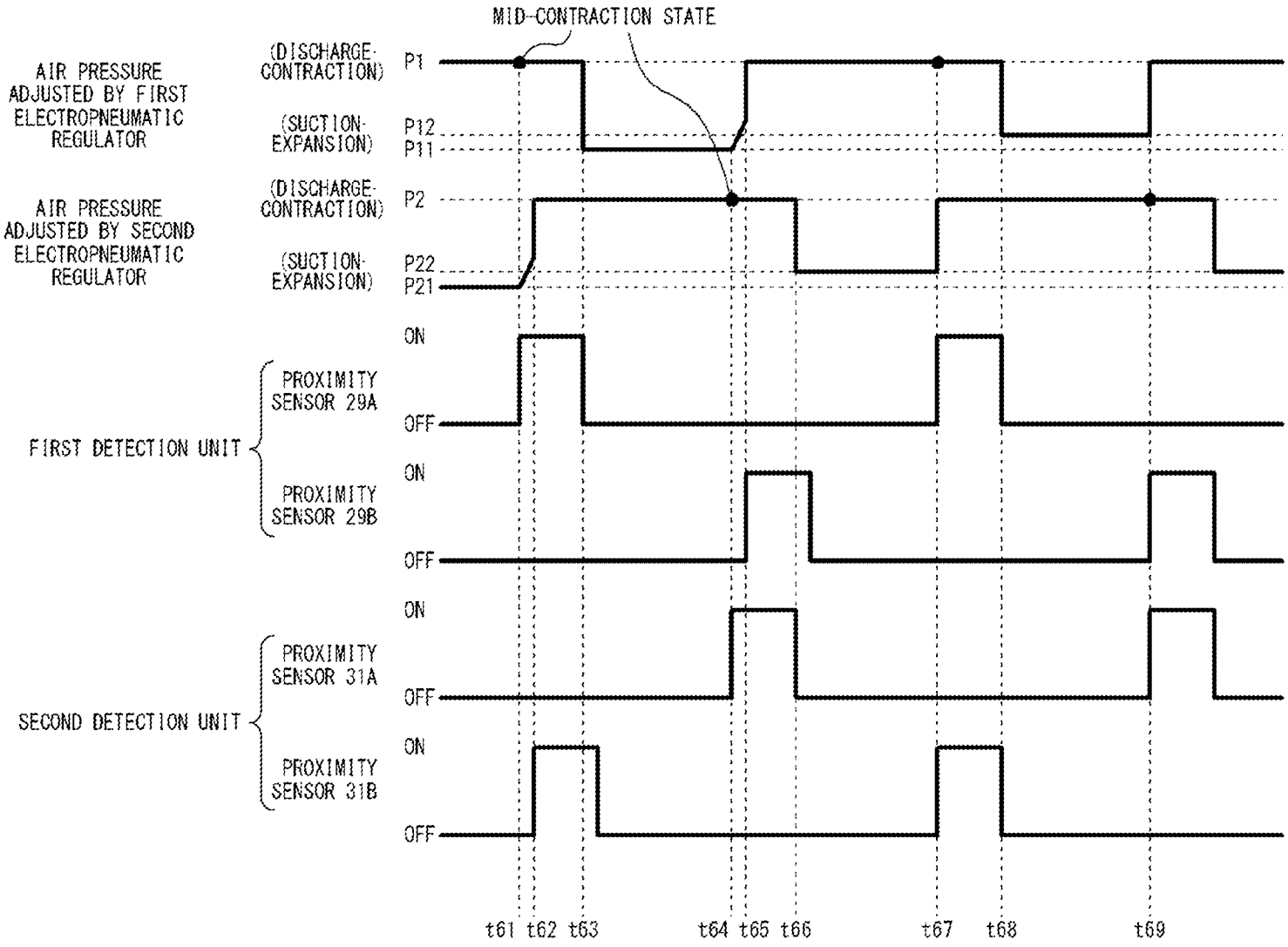
FIG. 8 is a time chart showing a specific example 1 of current-time pressure increase control.

FIG. 8 is a time chart showing a specific example 1 of current-time pressure increase control performed by the control unit 6 during drive control. The specific example 1 is a modification of FIG. 5, and current-time pressure increase control is performed in combination with next pressure increase control. Hereinafter, the specific example 1 of the current-time pressure increase control executed by the control unit 6 will be described with reference to FIG. 1 and FIG. 8. Here, as in FIG. 5, a description from a state where the first bellows 13 is in the middle of contraction operation (discharge) and the second bellows 14 is in the middle of expansion operation (suction) will be given.

At time t61 at which the proximity sensor 29A detects the mid-contraction state of the first bellows 13 (is turned ON), the control unit 6 determines whether or not the proximity sensor 31B has detected the expanded state of the second bellows 14 (been turned ON) (first determination). Here, at time t61, the proximity sensor 31B has not detected the expanded state of the second bellows 14 (has been OFF), and thus the control unit 6 determines that the proximity sensor 31B has not been turned ON. Due to this determination result, the control unit 6 executes the next pressure increase control at the next expansion of the second bellows 14 (time t66 to time t67) as described above.

Also, when the control unit 6 determines that the proximity sensor 31B has not been turned ON, the control unit 6 executes, at current time t61, current-time pressure increase control of controlling the second electropneumatic regulator 52 such that the air pressure of the pressurized air to be supplied to the second suction-side air chamber 26B is gradually increased. Specifically, the control unit 6 controls the second electropneumatic regulator 52 such that the air pressure of the pressurized air to be supplied to the second suction-side air chamber 26B gradually increases from a value P21 at current time t61. Accordingly, the expansion speed of the second bellows 14 which is in the middle of expansion at current time t61 gradually increases over time.

The control unit 6 continues the current-time pressure increase control until the proximity sensor 31B is turned ON. Therefore, since the expansion speed of the second bellows 14 which is in the middle of expansion increases until the proximity sensor 31B is turned ON, the second bellows 14 can be caused to quickly expand to the expanded state from current time t61. As a result, time t62 at which the second bellows 14 comes into the expanded state (time at which the proximity sensor 31B is turned ON) can be earlier than time t2 at which the second bellows 14 comes into the expanded state in FIG. 5 in which current-time pressure increase control is not performed. Control performed from time t62 to time t63 in FIG. 8 is the same as the control performed from time t2 to time t3 in FIG. 5, and thus the description thereof is omitted.

At time t64, when the proximity sensor 31A detects the mid-contraction state of the second bellows 14 (is turned ON), the control unit 6 determines whether or not the proximity sensor 29B has detected the expanded state of the first bellows 13 (been turned ON) (first determination). Here, at time t64, the proximity sensor 29B has not detected the expanded state of the first bellows 13 (has been OFF), and thus the control unit 6 determines that the proximity sensor 29B has not been turned ON. Due to this determination result, the control unit 6 executes the next pressure increase control at the next expansion of the first bellows 13 (time t68 to time t69) as described above.

Also, when the control unit 6 determines that the proximity sensor 29B has not been turned ON, the control unit 6 executes, at current time t64, current-time pressure increase control of controlling the first electropneumatic regulator 51 such that the air pressure of the pressurized air to be supplied to the first suction-side air chamber 26A is gradually increased. Specifically, the control unit 6 controls the first electropneumatic regulator 51 such that the air pressure of the pressurized air to be supplied to the first suction-side air chamber 26A gradually increases from a value P11 at current time t64. Accordingly, the expansion speed of the first bellows 13 which is in the middle of expansion at current time t64 gradually increases over time.

The control unit 6 continues the current-time pressure increase control until the proximity sensor 29B is turned ON. Therefore, since the expansion speed of the first bellows 13 which is in the middle of expansion increases until the proximity sensor 29B is turned ON, the first bellows 13 can be caused to quickly expand to the expanded state from current time t64. As a result, time t65 at which the first bellows 13 comes into the expanded state (time at which the proximity sensor 29B is turned ON) can be earlier than time t5 at which the first bellows 13 comes into the expanded state in FIG. 5 in which current-time pressure increase control is not performed. Control performed at and after time t65 in FIG. 8 is the same as the control performed at and after time t5 in FIG. 5, and thus the description thereof is omitted.

The control unit 6 in the specific example 1 executes the current-time pressure increase control at time t61 at which the first determination is performed, but may execute the current-time pressure increase control at an arbitrary time between time t61 and the time at which the first bellows 13 comes into the expanded state.

In addition, the control unit 6 uses the first determination, which is the criterion for executing the next pressure increase control, as the criterion for executing the current-time pressure increase control, but a determination that is the criterion for executing the current-time pressure increase control may be performed independently of the first determination. For example, the control unit 6 may perform the above determination at time t63 at which the first bellows 13 reaches the contracted state. In this case, the second bellows 14 which is in the middle of expansion at time t63 can be caused to quickly expand to the expanded state.

[Specific Example 2 of Current-Time Pressure Increase Control]

Figure 9:
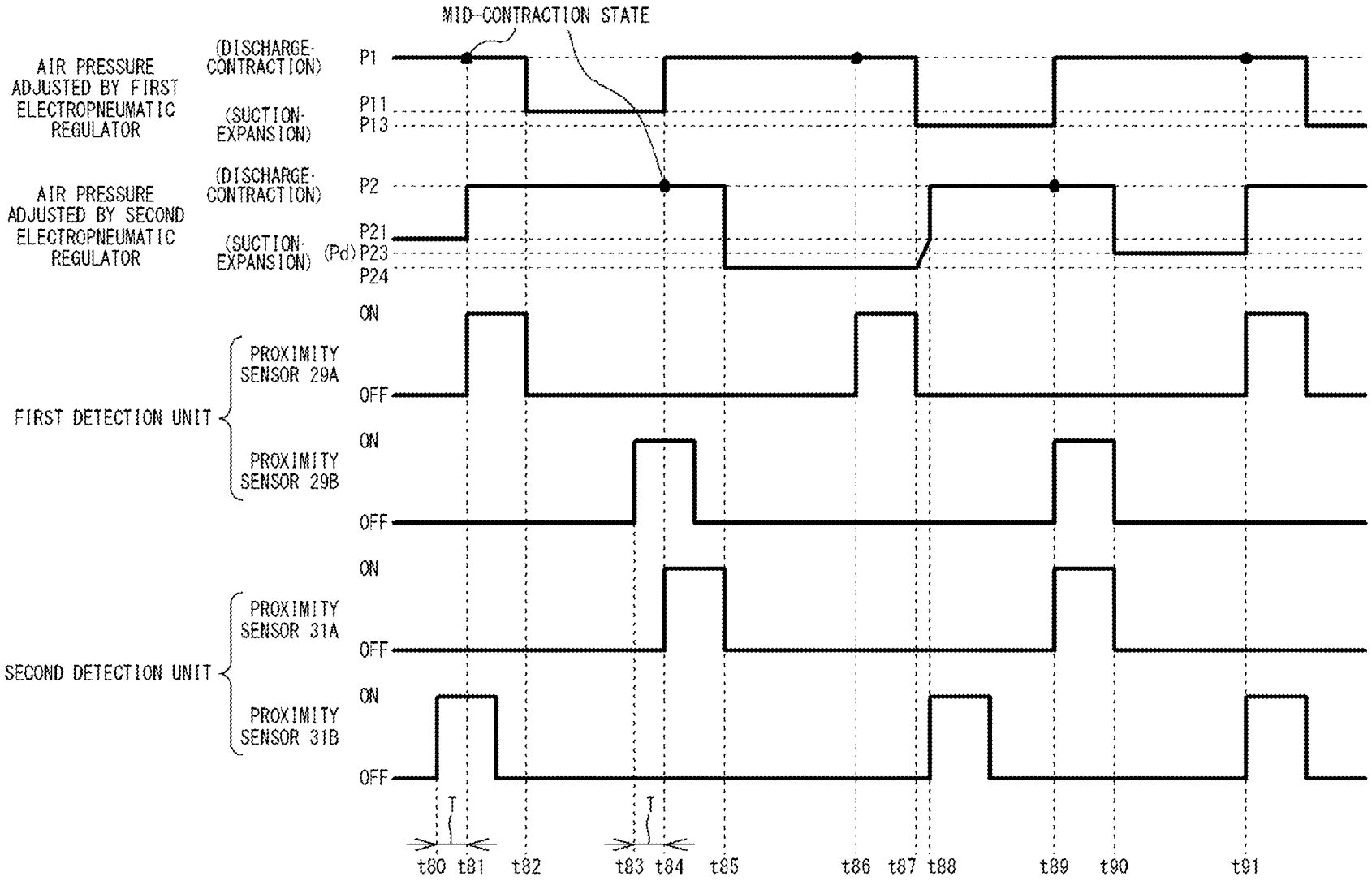
FIG. 9 is a time chart showing a specific example 2 of the current-time pressure increase control.

FIG. 9 is a time chart showing a specific example 2 of current-time pressure increase control performed by the control unit 6 during drive control. The specific example 2 is a modification of FIG. 7, and current-time pressure increase control is performed in combination with resetting of the lower limit after pressure decrease control is performed. Hereinafter, the specific example 2 of the current-time pressure increase control executed by the control unit 6 will be described with reference to FIG. 1 and FIG. 9. Control performed from time t80 to time t86 in FIG. 9 is the same as the control performed from time t40 to time t46 in FIG. 7, and thus the description thereof is omitted.

At time t87 at which the first bellows 13 reaches the contracted state, the control unit 6 determines whether or not the proximity sensor 31B has detected the expanded state of the second bellows 14 (been turned ON) (third determination). Here, at time t87, the second bellows 14 has not reached the expanded state, and thus the control unit 6 determines that the proximity sensor 31B has not been turned ON. Due to this determination result, the control unit 6 resets the lower limit of the range of air pressure adjustment by the second electropneumatic regulator 52 at the next expansion of the second bellows 14 (time t90 to time t91) as described above.

Also, when the control unit 6 determines that the proximity sensor 31B has not been turned ON, the control unit 6 executes, at current time t87, current-time pressure increase control of controlling the second electropneumatic regulator 52 such that the air pressure of the pressurized air to be supplied to the second suction-side air chamber 26B is gradually increased. Specifically, the control unit 6 controls the second electropneumatic regulator 52 such that the air pressure of the pressurized air to be supplied to the second suction-side air chamber 26B gradually increases from a value P24 at current time t87. Accordingly, the expansion speed of the second bellows 14 which is in the middle of expansion at current time t87 gradually increases over time.

The control unit 6 continues the current-time pressure increase control until the proximity sensor 31B is turned ON. Therefore, since the expansion speed of the second bellows 14 which is in the middle of expansion increases until the proximity sensor 31B is turned ON, the second bellows 14 can be caused to quickly expand to the expanded state from current time t87. As a result, time t88 at which the second bellows 14 comes into the expanded state (time at which the proximity sensor 31B is turned ON) can be earlier than time t48 at which the second bellows 14 comes into the expanded state in FIG. 7 in which current-time pressure increase control is not performed.

Control of the first bellows 13 performed at and after time t87 in FIG. 9 is the same as the control at and after time t47 in FIG. 7 (at and after time t27 in FIG. 6), and thus the description thereof is omitted. In addition, control of the second bellows 14 performed at and after time t88 in FIG. 9 is the same as the control at and after time t48 in FIG. 7, and thus the description thereof is omitted. Moreover, although the current-time pressure increase control of the second electropneumatic regulator 52 has been described with reference to FIG. 9, current-time pressure increase control of the first electropneumatic regulator 51 is the same as described above, and thus the description thereof is omitted.

The control unit 6 in the specific example 2 uses the third determination, which is the criterion for resetting the lower limit, as the criterion for executing the current-time pressure increase control, but a determination that is the criterion for executing the current-time pressure increase control may be performed independently of the third determination. For example, the control unit 6 may perform the above determination at time t86 at which the first bellows 13 reaches the mid-contraction state. In this case, the control unit 6 may execute the current-time pressure increase control at time t86 at which the above determination is performed, or may execute the current-time pressure increase control at an arbitrary time between time t86 and the time at which the first bellows 13 comes into the expanded state.

Advantageous Effects of Present Embodiment

As described above, in the bellows pump device 1 of the present embodiment, when the first bellows 13 (second bellows 14) contracts to the mid-contraction state, the second bellows 14 (first bellows 13) has not expanded to the expanded state in some cases. In such a case, the control unit 6 performs next pressure increase control of increasing the air pressure of the pressurized air to be supplied to the second suction-side air chamber 26B (first suction-side air chamber 26A) of the second driving unit 28 (first driving unit 27) at the next expansion of the second bellows 14 (first bellows 13). Accordingly, when the expansion time of the second bellows 14 (first bellows 13) becomes long, the air pressure of the pressurized air for causing the second bellows 14 (first bellows 13) to expand can be automatically reset to a higher value. As a result, the next expansion time of the second bellows 14 (first bellows 13) becomes shorter, so that deterioration of pulsation at the discharge side of the bellows pump device 1 due to the expansion time becoming longer can be suppressed.

Moreover, when the first bellows 13 (second bellows 14) contracts to the mid-contraction state, if the second bellows 14 (first bellows 13) has not expanded to the expanded state, for the second bellows 14 (first bellows 13) which is expanding at the current time, the control unit 6 performs current-time pressure increase control of gradually increasing the air pressure of the pressurized air currently supplied to the second suction-side air chamber 26B (first suction-side air chamber 26A) of the second driving unit 28 (first driving unit 27). Accordingly, when the expansion time of the second bellows 14 (first bellows 13) becomes long, the air pressure of the pressurized air for causing the second bellows 14 (first bellows 13) to expand can be automatically reset such that the air pressure gradually becomes higher values. As a result, the expansion time of the second bellows 14 (first bellows 13) at the current time becomes shorter, so that deterioration of pulsation at the discharge side of the bellows pump device 1 due to the expansion time becoming longer can be suppressed.

Moreover, by performing the current-time pressure increase control, the second bellows 14 (first bellows 13) which is in the middle of expansion at the current time can be reliably caused to expand to the expanded state without stopping the second bellows 14 (first bellows 13) in the middle of expansion. As a result, the next pressure increase control can be reliably performed at the next expansion of the second bellows 14 (first bellows 13).

When the first bellows 13 (second bellows 14) contracts to the mid-contraction state, the second bellows 14 (first bellows 13) has continued to be in the expanded state for a predetermined time or longer in some cases. In such a case, the control unit 6 performs pressure decrease control of decreasing the air pressure of the pressurized air to be supplied to the second suction-side air chamber 26B (first suction-side air chamber 26A) of the second driving unit 28 (first driving unit 27) at the next expansion of the second bellows 14 (first bellows 13). Accordingly, when the expansion time of the second bellows 14 (first bellows 13) becomes shorter than necessary, the air pressure of the pressurized air for causing the second bellows 14 (first bellows 13) to expand can be automatically reset to a lower value. As a result, the next expansion time of the second bellows 14 (first bellows 13) becomes longer, and the expansion speed thereof decreases, so that generation of an impact pressure or occurrence of cavitation can be suppressed.

In the case where the control unit 6 performs the pressure decrease control, when the first bellows 13 (second bellows 14) contracts to the contracted state, the second bellows 14 (first bellows 13) has not expanded to the expanded state in some cases. In such a case, the control unit 6 resets the lower limit of the range of air pressure adjustment by the second electropneumatic regulator 52 (first electropneumatic regulator 51) at the next expansion of the second bellows 14 (first bellows 13) such that the lower limit is higher than the air pressure at the last expansion of the other bellows. Accordingly, the air pressure adjusted by the second electropneumatic regulator 52 (first electropneumatic regulator 51) at the next expansion of the second bellows 14 (first bellows 13) can be prevented from being lower than the lower limit Pd, so that the expansion time of the second bellows 14 (first bellows 13) can be inhibited from becoming excessively long. As a result, deterioration of pulsation at the discharge side of the bellows pump device 1 due to the expansion time becoming longer can be suppressed.

Moreover, the lower limit that is reset at the next expansion of the second bellows 14 (first bellows 13) is also applied as the lower limit of the range of air pressure adjustment by the second electropneumatic regulator 52 (first electropneumatic regulator 51) at the expansion of the second bellows 14 (first bellows 13) subsequent to the next expansion thereof. Therefore, even when the pressure decrease control is executed at the expansion of the second bellows 14 (first bellows 13) subsequent to the next expansion thereof, the air pressure decreased by the pressure decrease control does not become lower than the lower limit Pd. Therefore, occurrence of a situation in which the expansion time of the second bellows 14 (first bellows 13) becomes long due to the pressure decrease control and the second bellows 14 (first bellows 13) cannot be caused to contract from the expanded state before the first bellows 13 (second bellows 14) comes into the contracted state, can be suppressed. As a result, deterioration of pulsation at the discharge side of the bellows pump device 1 can be further suppressed.

When the first bellows 13 (second bellows 14) contracts to the contracted state by the pressure decrease control, if the second bellows 14 (first bellows 13) has not expanded to the expanded state, the control unit 6 may reset the lower limit of the range of air pressure adjustment by the second electropneumatic regulator 52 (first electropneumatic regulator 51) at the expansion of the second bellows 14 (first bellows 13) immediately after the next time such that the lower limit is higher than the air pressure at the last expansion of the other bellows. This is because the next pressure increase control is executed at the next expansion of the second bellows 14 (first bellows 13), and the air pressure is increased by the second electropneumatic regulator 52 (first electropneumatic regulator 51) even if the lower limit is not reset, so that it is not necessary to reset the lower limit at the next expansion of the second bellows 14 (first bellows 13). Accordingly, the air pressure adjusted by the second electropneumatic regulator 52 (first electropneumatic regulator 51) at the expansion of the second bellows 14 (first bellows 13) immediately after the next time can be prevented from being lower than the lower limit Pd, so that the expansion time of the second bellows 14 (first bellows 13) can be inhibited from becoming excessively long. As a result, deterioration of pulsation at the discharge side of the bellows pump device 1 due to the expansion time becoming longer can be suppressed.

Moreover, the lower limit that is reset at the expansion of the second bellows 14 (first bellows 13) immediately after the next time is also applied as the lower limit of the range of air pressure adjustment by the second electropneumatic regulator 52 (first electropneumatic regulator 51) at the expansion of the second bellows 14 (first bellows 13) subsequent to the expansion thereof immediately after the next time. Therefore, even when the pressure decrease control is executed at the expansion of the second bellows 14 (first bellows 13) subsequent to the expansion thereof immediately after the next time, the air pressure decreased by the pressure decrease control does not become lower than the lower limit Pd. Therefore, occurrence of a situation in which the expansion time of the second bellows 14 (first bellows 13) becomes long due to the pressure decrease control and the second bellows 14 (first bellows 13) cannot be caused to contract from the expanded state before the first bellows 13 (second bellows 14) comes into the contracted state, can be suppressed. As a result, deterioration of pulsation at the discharge side of the bellows pump device 1 can be further suppressed.

Moreover, when the first bellows 13 (second bellows 14) contracts to the contracted state by the control unit 6 performing the pressure decrease control, if the second bellows 14 (first bellows 13) has not expanded to the expanded state, the control unit 6 performs current-time pressure increase control of gradually increasing the air pressure of the pressurized air for the second bellows 14 (first bellows 13) which is expanding at the current time. Accordingly, the expansion time of the second bellows 14 (first bellows 13) at the current time can be shortened. As a result, deterioration of pulsation at the discharge side of the bellows pump device 1 due to the expansion time becoming longer can be suppressed. In addition, insufficient suction of the transport fluid due to expansion of the second bellows 14 (first bellows 13) can be suppressed, so that stop of the bellows pump device 1 due to the insufficient suction can be suppressed.

Moreover, by performing the current-time pressure increase control, the second bellows 14 (first bellows 13) which is in the middle of expansion at the current time can be reliably caused to expand to the expanded state without stopping the second bellows 14 (first bellows 13) in the middle of expansion. As a result, the lower limit can be reliably reset at the next expansion of the second bellows 14 (first bellows 13).

Since the first detection unit 29 and the second detection unit 31 which are used for the drive control of the first driving unit 27 and the second driving unit 28 also serve as a pair of detection units used for the current-time pressure increase control, the next pressure increase control, and the pressure decrease control, the configuration of the bellows pump device 1 can be simplified.

[Others]

In the above embodiment, the first detection unit 29 is composed of the proximity sensors 29A and 29B, but may be composed of a displacement sensor using laser light or the like. Similarly, the second detection unit 31 is composed of the proximity sensors 31A and 31B, but may be composed of a displacement sensor using laser light or the like.

Moreover, in the above embodiment, the first detection unit 29 and the second detection unit 31 which are used for the drive control of the first driving unit 27 and the second driving unit 28 also serve as a pair of detection units used for the current-time pressure increase control, the next pressure increase control, and the pressure decrease control, but the pair of detection units may be provided separately from the first detection unit 29 and the second detection unit 31.

The embodiment disclosed herein is merely illustrative and not restrictive in all aspects. The scope of the present invention is defined by the scope of the claims rather than the meaning described above, and is intended to include meaning equivalent to the scope of the claims and all modifications within the scope.

REFERENCE SIGNS LIST

1 bellows pump device
6 control unit
13 first bellows (bellows)
14 second bellows (bellows)
21A first discharge-side air chamber (discharge-side fluid chamber)
21B second discharge-side air chamber (discharge-side fluid chamber)
26A first suction-side air chamber (suction-side fluid chamber)
26B second suction-side air chamber (suction-side fluid chamber)
27 first driving unit (driving unit)
28 second driving unit (driving unit)
29 first detection unit (detection unit)
31 second detection unit (detection unit)
51 first electropneumatic regulator (fluid pressure adjustment unit)
52 second electropneumatic regulator (fluid pressure adjustment unit)

The invention claimed is:

1. A bellows pump device comprising:

a first bellows that is expandable and contractible and configured to suck a transport fluid thereinto by expansion thereof and to discharge the transport fluid therefrom by contraction thereof;

a second bellows expandable and contractible independently of the first bellows and configured to suck a transport fluid thereinto by expansion thereof and to discharge the transport fluid therefrom by contraction thereof;

a first driving unit having a first suction-side fluid chamber and a first discharge-side fluid chamber and configured to cause the first bellows to expand to a predetermined expanded state by supplying a pressurized fluid to the first suction-side fluid chamber and to cause the first bellows to contract to a predetermined contracted state by supplying the pressurized fluid to the first discharge-side fluid chamber;

a second driving unit having a second suction-side fluid chamber and a second discharge-side fluid chamber and configured to cause the second bellows to expand to a predetermined expanded state by supplying a pressurized fluid to the second suction-side fluid chamber and to cause the second bellows to contract to a predetermined contracted state by supplying the pressurized fluid to the second discharge-side fluid chamber;

a control unit configured to perform drive control of the first driving unit and the second driving unit such that, before one bellows out of the first bellows and the second bellows comes into the predetermined contracted state, the other bellows is caused to contract from the predetermined expanded state;

a first detection unit configured to detect the predetermined expanded state of the first bellows and a mid-contraction state in which the first bellows is closer to the predetermined contracted state than to the predetermined expanded state;

a second detection unit configured to detect the predetermined expanded state of the second bellows and a mid-contraction state in which the second bellows is closer to the predetermined contracted state than to the predetermined expanded state;

a first fluid pressure adjustment unit configured to adjust a fluid pressure of the pressurized fluid to be supplied to the first suction-side fluid chamber of the first driving unit; and a second fluid pressure adjustment unit configured to adjust a fluid pressure of the pressurized fluid to be supplied to the second suction-side fluid chamber of the second driving unit, wherein the control unit performs next pressure increase control of:

controlling the first fluid pressure adjustment unit such that the fluid pressure at a next expansion of the first bellows is increased upon determining, on the basis of respective detection signals of the first detection unit and the second detection unit, whether or not the first bellows is in the predetermined expanded state when the second bellows contracts to the mid-contraction state, and in response to a determination result of the determination being negative; and controlling the second fluid pressure adjustment unit such that the fluid pressure at a next expansion of the second bellows is increased upon determining, on the basis of respective detection signals of the first detection unit and the second detection unit, whether or not the second bellows is in the predetermined expanded state when the first bellows contracts to the mid-contraction state, and in response to a determination result of the determination being negative.

2. The bellows pump device according to claim 1, wherein the control unit performs pressure decrease control of:

controlling the first fluid pressure adjustment unit such that the fluid pressure at the next expansion of the first bellows is decreased, upon determining, on the basis of the respective detection signals of the first detection unit and the second detection unit, whether or not the first bellows has continued to be in the predetermined expanded state for a predetermined time or longer when the second bellows contracts to the mid-contraction state, and in response to a determination result of the determination being positive; and controlling the second fluid pressure adjustment unit such that the fluid pressure at the next expansion of the second bellows is decreased, upon determining, on the basis of the respective detection signals of the first detection unit and the second detection unit, whether or not the second bellows has continued to be in the predetermined expanded state for a predetermined time or longer when the first bellows contracts to the mid-contraction state, and in response to a determination result of the determination being positive.

3. The bellows pump device according to claim 2, wherein the control unit determines whether or not the first bellows is in the predetermined expanded state when the second bellows contracts to the predetermined contracted state, on the basis of the respective detection signals of the first detection unit and the second detection unit, and when a determination result of the determination is negative, the control unit sets a lower limit of a range of adjustment of the fluid pressure by the first fluid pressure adjustment unit at expansion of the first bellows subsequent to the next expansion thereof such that the lower limit is higher than the fluid pressure at the last expansion of the first bellows, and the control unit determines whether or not the second bellows is in the predetermined expanded state when the first bellows contracts to the predetermined contracted state, on the basis of the respective detection signals of the first detection unit and the second detection unit, and when a determination result of the determination is negative, the control unit sets a lower limit of a range of adjustment of the fluid pressure by the second fluid pressure adjustment unit at expansion of the second bellows subsequent to the next expansion thereof such that the lower limit is higher than the fluid pressure at the last expansion of the second bellows.

4. The bellows pump device according to claim 1, wherein the control unit performs the drive control on the basis of the respective detection signals of the first detection unit and the second detection unit.

* * * * *